US007451614B2

(12) United States Patent
Luehrs et al.

(10) Patent No.: US 7,451,614 B2
(45) Date of Patent: Nov. 18, 2008

(54) REFRIGERATION SYSTEM AND COMPONENTS THEREOF

(75) Inventors: Frederick G. Luehrs, Menomonee Falls, WI (US); Henry Groth, Jr., Colgate, WI (US); Karl R. Krumbiegel, Cedarburg, WI (US); Ryan K. Marks, West Bend, WI (US); Kevin M. Rehm, Milwaukee, WI (US); Gottfried Urban, Greenfield, WI (US); Timothy Alan Gilbertson, Little Chute, WI (US); Dennis Weigand, Theresa, WI (US)

(73) Assignee: Perlick Corporation, Milwaukee, WI (US)

( * ) Notice: Subject to any disclaimer, the term of this patent is extended or adjusted under 35 U.S.C. 154(b) by 498 days.

(21) Appl. No.: 10/815,551

(22) Filed: Apr. 1, 2004

(65) Prior Publication Data

US 2005/0217310 A1 Oct. 6, 2005

(51) Int. Cl.
*F25D 11/02* (2006.01)

(52) U.S. Cl. ..... 62/441

(58) Field of Classification Search ..... 62/441, 62/278, 443, 447
See application file for complete search history.

(56) References Cited

U.S. PATENT DOCUMENTS

| | | | | |
|---|---|---|---|---|
| 1,870,685 | A | | 8/1932 | Lockwood |
| 1,880,735 | A | | 10/1932 | Bonine |
| 2,353,909 | A | | 7/1944 | Lager |
| 2,508,385 | A | | 5/1950 | Hall |
| 2,633,714 | A | | 4/1953 | Wehby |
| 2,677,244 | A | | 5/1954 | Wehby |
| 2,677,246 | A | | 5/1954 | Wehby |
| 2,737,782 | A | | 3/1956 | Antico |
| 3,010,289 | A | | 11/1961 | Kuklinski |
| 3,057,284 | A | | 10/1962 | Learmont |
| 3,184,926 | A | | 5/1965 | Blake |
| 3,234,748 | A | | 2/1966 | Quick |
| 3,234,753 | A | | 2/1966 | Quick |
| 3,234,754 | A | | 2/1966 | Quick |
| 3,287,925 | A | | 11/1966 | Kane et al. |
| 3,464,226 | A | | 9/1969 | Kramer |
| 3,580,006 | A | | 5/1971 | Quick |
| 3,638,450 | A | | 2/1972 | Falk |
| 3,645,109 | A | | 2/1972 | Quick |
| 3,850,714 | A | | 11/1974 | Adorjan |
| 3,864,936 | A | | 2/1975 | Frank et al. |
| 4,325,224 | A | | 4/1982 | Howland |
| 4,327,558 | A | | 5/1982 | Howland et al. |
| 4,367,634 | A | * | 1/1983 | Bolton ..... 62/238.6 |
| 4,505,126 | A | | 3/1985 | Jones et al. |

(Continued)

OTHER PUBLICATIONS

The Wine Enthusiast, The Ultimate Wine Cellar and Unique Gift Guide Catalog; Winter 2004 V.76.2.

*Primary Examiner*—Melvin Jones
(74) *Attorney, Agent, or Firm*—Nicholas A. Kees; Godfrey & Kahn, S.C.

(57) ABSTRACT

A refrigeration system having a container with at least two different temperature cooling zones separated by a divider. The divider has a wall and a partition spaced apart from each other. The partition has a heat transfer plate with a sheet with a heat transfer substance attached thereto. The refrigeration system may be cooled by a variable capacity compressor system having refrigeration and hot-gas defrost modes. The system is defrosted by circulation of gas therethrough. A controller may be engaged to and selectably operate the compressor system.

28 Claims, 12 Drawing Sheets

U.S. PATENT DOCUMENTS 4,553,584 A 11/1985 Bloomquist
4,565,071 A 1/1986 Bartling et al.
4,685,306 A 8/1987 Howland et al.
4,706,468 A 11/1987 Howland et al.
4,711,095 A 12/1987 Howland et al.
4,712,383 A 12/1987 Howland et al.
4,748,823 A 6/1988 Asano et al.
4,765,150 A 8/1988 Persem
4,831,835 A 5/1989 Beehler et al.
4,852,365 A 8/1989 Elrod et al.
4,920,758 A * 5/1990 Janke et al. ..... 62/187
4,944,158 A 7/1990 Akiike et al.
4,979,371 A 12/1990 Larson
RE33,620 E 6/1991 Persem
5,029,450 A 7/1991 Takano et al.
5,048,306 A 9/1991 Wakatsuki et al.
5,054,295 A 10/1991 Goulooze
5,065,587 A 11/1991 Howland et al.
5,081,850 A 1/1992 Wakatsuki et al.
RE34,047 E 9/1992 Elrod et al.
5,269,149 A 12/1993 Zeidler
5,315,836 A * 5/1994 Ressler ..... 62/81
5,449,232 A 9/1995 Westbrooks, Jr. et al.
D365,828 S 1/1996 Lacewell et al.
D367,864 S 3/1996 Lacewell
D368,394 S 4/1996 Rogers
5,567,026 A 10/1996 Lacewell
5,771,959 A 6/1998 Westbrooks, Jr. et al.
5,797,445 A 8/1998 Westbrooks, Jr. et al.
6,000,232 A 12/1999 Witten-Hannah et al.
6,170,277 B1 1/2001 Porter et al.
6,176,095 B1 1/2001 Porter
6,467,293 B1 10/2002 Goosman
6,564,574 B1 5/2003 Pereira et al.
6,606,873 B2 8/2003 Takeuchi
6,640,569 B2 11/2003 Goosman
6,662,579 B2 12/2003 Takano et al.
6,698,210 B2 * 3/2004 Ogura et al. ..... 62/6
2001/0039807 A1 * 11/2001 Mogil ..... 62/371
2003/0012946 A1 * 1/2003 Davis et al. ..... 428/319.3
2003/0046943 A1 3/2003 Takano et al.
2003/0066300 A1 4/2003 Takeuchi

* cited by examiner

REFRIGERATION SYSTEM AND COMPONENTS THEREOF

BACKGROUND OF THE INVENTION

This invention relates generally to a refrigeration system and components thereof, and in particular, to a system having different temperature zones for cooling various food and beverage articles.

People have used refrigerated devices to cool and freeze food and beverage articles for many years. Traditionally, these devices utilize a compressor functionally connected to an insulated container. The compressor and associated components and piping change the pressure of refrigerant to absorb heat from the insulated container. A fan system circulates air into and inside the insulated container. A temperature control device is typically connected to the compressor. The temperature control device cycles the compressor on and off as needed to maintain a desired temperature in the insulated container.

Cycling a compressor on and off requires a significant amount of energy and results in rather loud noises. Variable capacity compressors have been created to provide a compressor that is continuously operating. The speeds of the compressor can be varied substantially and continuously over a wide range of predefined speeds. Such compressors are disclosed in U.S. Pat. Nos. RE 33,620 to Persem and 4,765,150 to Persem.

Operation of variable capacity compressors, like all compressors, results in frost building up on the heat exchange elements. The compressors must be routinely defrosted so that the compressor may operate optimally. One method of defrosting involves running hot gas either through or near the heat exchange elements. Such defrost mechanisms are disclosed in U.S. Pat. Nos. 4,979,371 to Larson; 3,234,754 to Quick; 3,234,753 to Quick; 3,234,748 to Quick; and 3,645,109 to Quick. None of these mechanisms have been designed or utilized with variable capacity compressors. Further, all these mechanisms utilize extensive networks of tubing and control valves to accomplish defrosting.

Many refrigeration devices also have different temperature zones. For example, the common home refrigerator has a freezer section and a refrigeration section. Creating different temperatures in different sections of a refrigeration device can be accomplished in at least two methods. One method involves using a different compressor for each section. Another method involves using fans or the like to circulate cold air from a colder section to a warmer section. The operation of the fans may be controlled by a temperature control device.

For example, U.S. Pat. No. 4,505,126 to Jones et al. discloses a food product transport system, wherein motorized fans are used to circulate air from one section to another. The fans are positioned in partitions separating the different sections. U.S. Pat. No. 6,000,232 to Witten-Hannah et al. discloses a refrigeration system having a freezer section and a refrigeration section in parallel alignment. This patent further discloses a method wherein motorized fans are used to control the amount of chilled air entering each section. U.S. Pat. No. 5,081,850 to Wakatsuki et al. discloses a refrigerator that has two sections separated by a partition, wherein cool air is circulated throughout the sections and through the partition. All of these devices require the circulation of air from one section to another to create different temperatures in each section.

Accordingly, a need exists for an improved refrigeration system and components thereof that solves these and other deficiencies in the prior art. Of course, the present invention may be used in a multitude of situations where similar performance capabilities are required.

SUMMARY OF THE INVENTION

The present invention provides a refrigeration system that is cost-effective to manufacture, efficient to operate, relatively quiet when functioning, and overcomes certain of the deficiencies in the prior art. The invention provides for a refrigeration system and components thereof. In one embodiment, the refrigeration system has a container with at least two different temperature cooling zones, which are separated by a divider. The divider has a wall and a partition spaced apart from each other. The partition has a heat transfer plate, which has a sheet with a heat transfer substance attached thereto. In one embodiment, the refrigeration system is cooled by a compressor system having refrigeration and hot-gas defrost modes. A controller controls and selectably operates the compressor system. Preferably, the compressor system has a variable capacity compressor.

The present invention also provides for a compressor system, which is a closed system, wherein an evaporator is functionally connected to a variable capacity compressor. The compressor system selectably operates in at least a refrigeration mode and a hot-gas defrost mode. During the hot-gas defrost mode, the evaporator is defrosted by circulation of gas therethrough. In one embodiment, the compressor system has a variable capacity compressor connected to a condenser, which is further connected to a drier, which in turn is connected to a hot-gas by-pass valve and a heat exchanger. The hot-gas by-pass valve and heat exchanger are connected in parallel to one another and are both connected to an evaporator. The evaporator is connected to the variable capacity compressor to form the closed system. A controller may selectably open and close the hot gas bypass valve.

While one possible application of the present invention is in connection with residential and commercial refrigeration of food and beverage articles, many other applications are possible and references to use in connection with residential and commercial situations should not be deemed to limit the uses of the present invention. The terms "heat exchanger," "evaporator," "condenser," "capillary tube," "fan," "cabinet," "door," "damper," "compressor," "by-pass valve," and "heat transfer panel" as used herein should not be interpreted as being limited to specific forms, shapes, numbers, or compositions of a heat exchanger, evaporator, condenser, capillary tube, fan, cabinet, door, damper, compressor, by-pass valve, and heat transfer panel. Rather, the evaporator, condenser, capillary tube, fan, cabinet, door, damper, compressor, by-pass valve, and heat transfer panel may have a wide variety of shapes and forms, may be provided in a wide variety of numbers, and may be composed of a wide variety of materials. These and other objects and advantages of the present invention will become apparent from the detailed description, claims, and accompanying drawings.

DETAILED DESCRIPTION OF THE PREFERRED EMBODIMENTS

Figure 1:
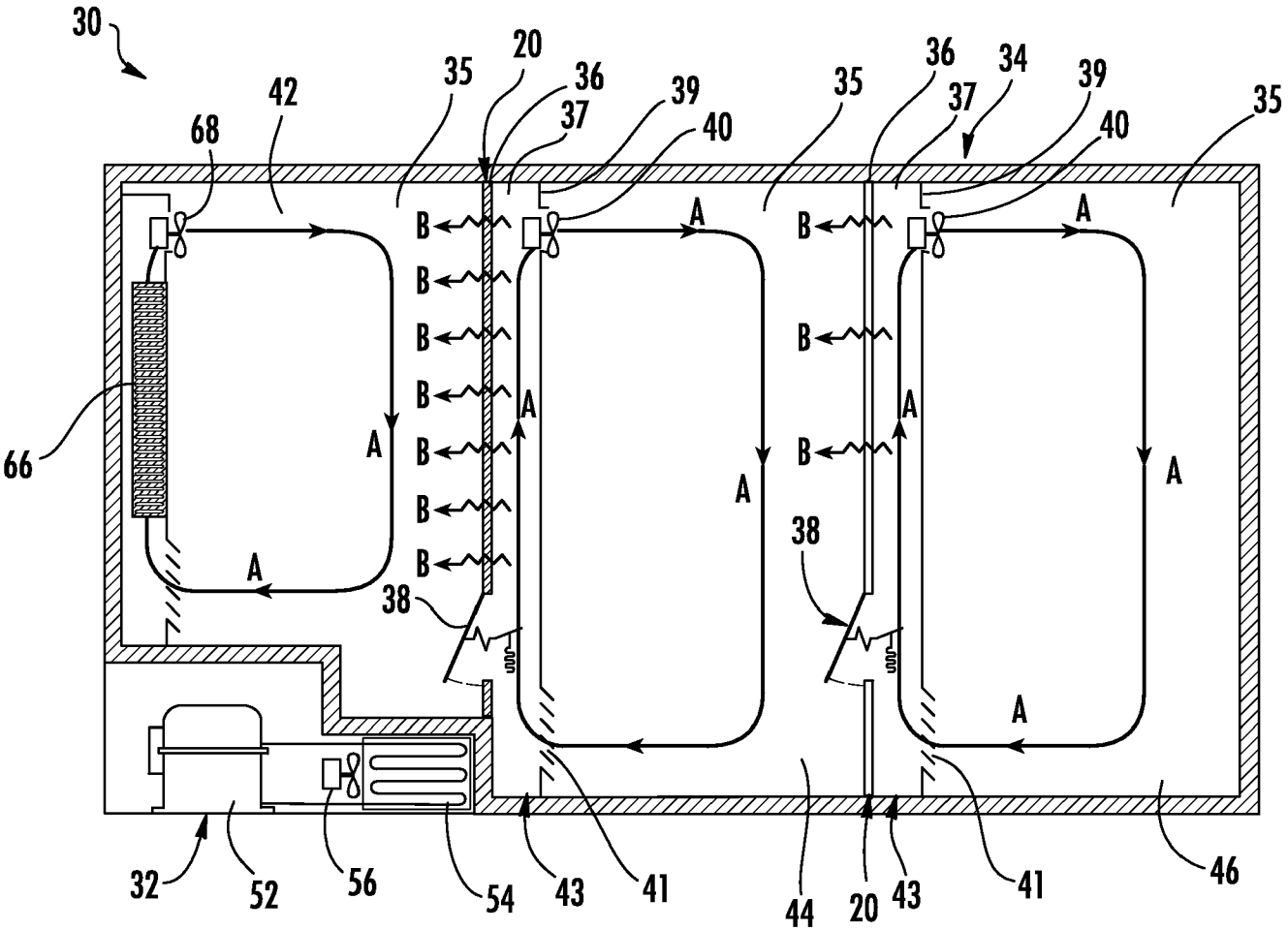
FIG. 1 is a partial cross sectional view of a refrigeration system in accordance with one embodiment of the present invention.

Illustrative embodiments of a refrigeration system (identified generally as 30) in accordance with the present invention are shown in FIGS. 1 through 12. While the invention may be susceptible to embodiment in different forms, there are shown in the drawings, and herein are described in detail, certain illustrative embodiments with the understanding that the present disclosure is to be considered an exemplification of the principles of the invention, and is not intended to limit the invention to those as illustrated and described herein. Additionally, features illustrated and described with respect to one embodiment could be used in connection with other embodiments.

The present invention provides a refrigeration system 30 to cool at least one cooling compartment or cooling zone 35. A cooling system, preferably a compressor system 32, is functionally connected to the cooling zone 35 and effectively cools the cooling zone 35. In a preferred embodiment, a portion of the compressor system 32, specifically an evaporator 66, is positioned inside a cooling zone 35. A fan 68 circulates air inside the cooling zone 35 and past the evaporator 66, thus cooling the air. The refrigeration system 30 may have more than one cooling zone 35. Multiple cooling zones 35 may be separated by at least one heat transfer panel 20.

In one embodiment, shown in FIGS. 1-4, the cooling system is a compressor system 32. The compressor system 32 has a series of components functionally engaged to one another to form a closed system. Refrigerant, variously in the form of liquid or gas, is circulated in the compressor system 32. The compressor system 32 has a compressor 52, which is preferably a variable capacity compressor. Examples of such variable capacity compressors include those disclosed in U.S. Pat. Nos. RE 33,620 to Persem and 4,765,150 to Persem, which are hereby incorporated in their entireties for all purposes. Variable capacity compressors found effective in the present invention include without limitation those manufactured and sold by Embraco of Joinville, S.C., Brazil (sales through Embraco North America of Duluth, Ga.) such as model VEGY 7H or VEGY 8H. The compressor 52 is connected to a condenser 54. Condensers found effective in the present invention include without limitation those manufactured and sold by Outokumpu Heatcraft USA, LLC. of Grenada, Miss. A condenser fan 56, such as model 9906L manufactured and sold by EBM Industries, Inc. of Farmington, Conn., may be provided in relation to the condenser 54 to circulate air around the condenser 54. The condenser 54 is connected to a drier 58. Driers found effective in the present invention include without limitation those manufactured and sold by Parker-Hannifin Corp., Climate Systems Division, of Greenfield, Tenn. In one embodiment, a dual inlet drier is utilized by oriented such that the direr has one inlet and two outlets. The drier 58 is connected in parallel to a hot gas by-pass valve 60 and a capillary tube 62. By-pass valves found effective in the present invention include without limitation those manufactured and sold by Parker-Hannifin Corp., Fluid Control Division, of New Britain, Conn., preferably model number 04E20C1-Z01ABBOSO5. While these components may be housed in any portion of the cabinet 34 of the refrigeration system 30, it is preferable that these components are not positioned inside the cooling zones 35.

Figure 2:
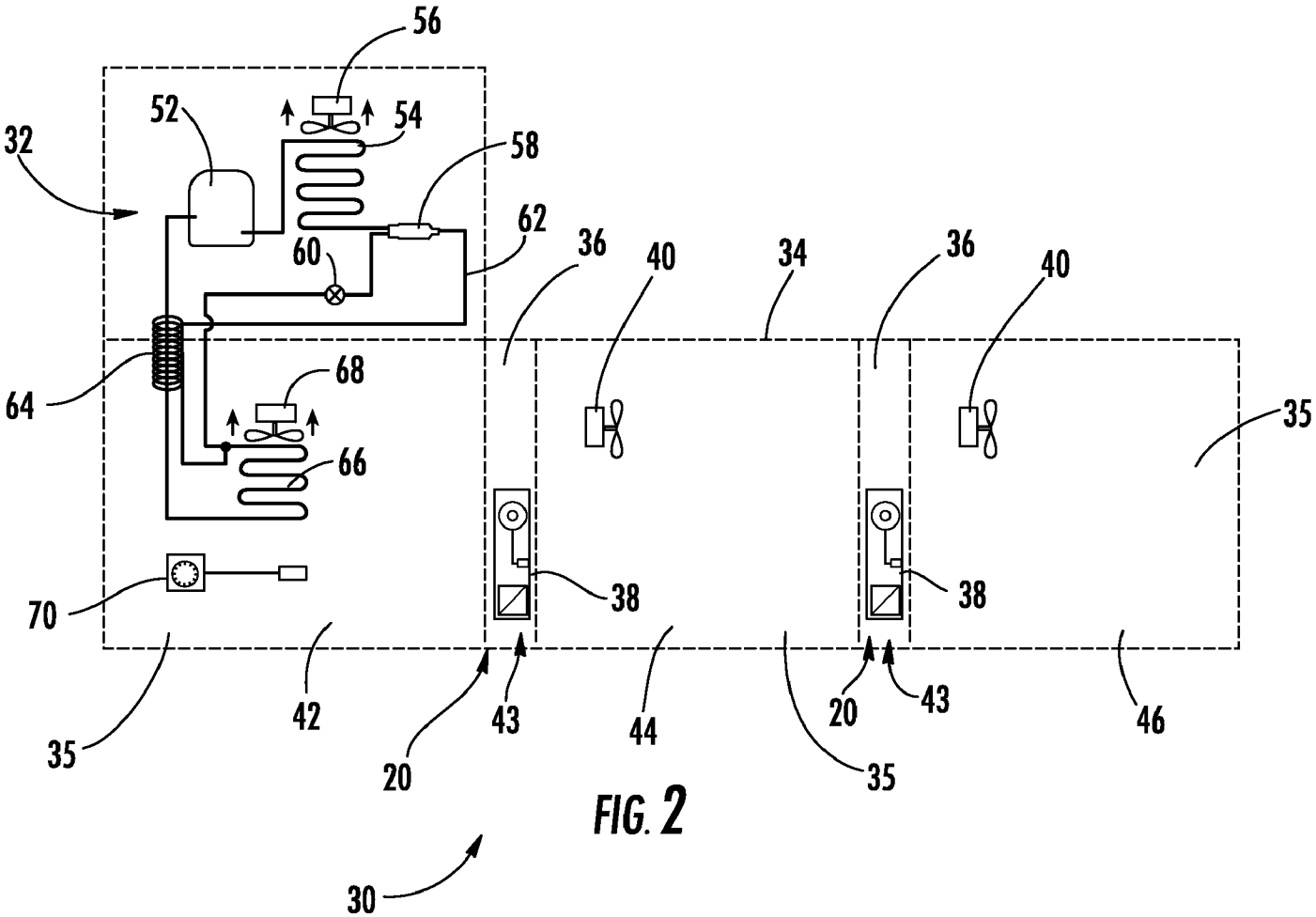
FIG. 2 is a schematic view of the refrigeration system of FIG. 1.
Figure 3:
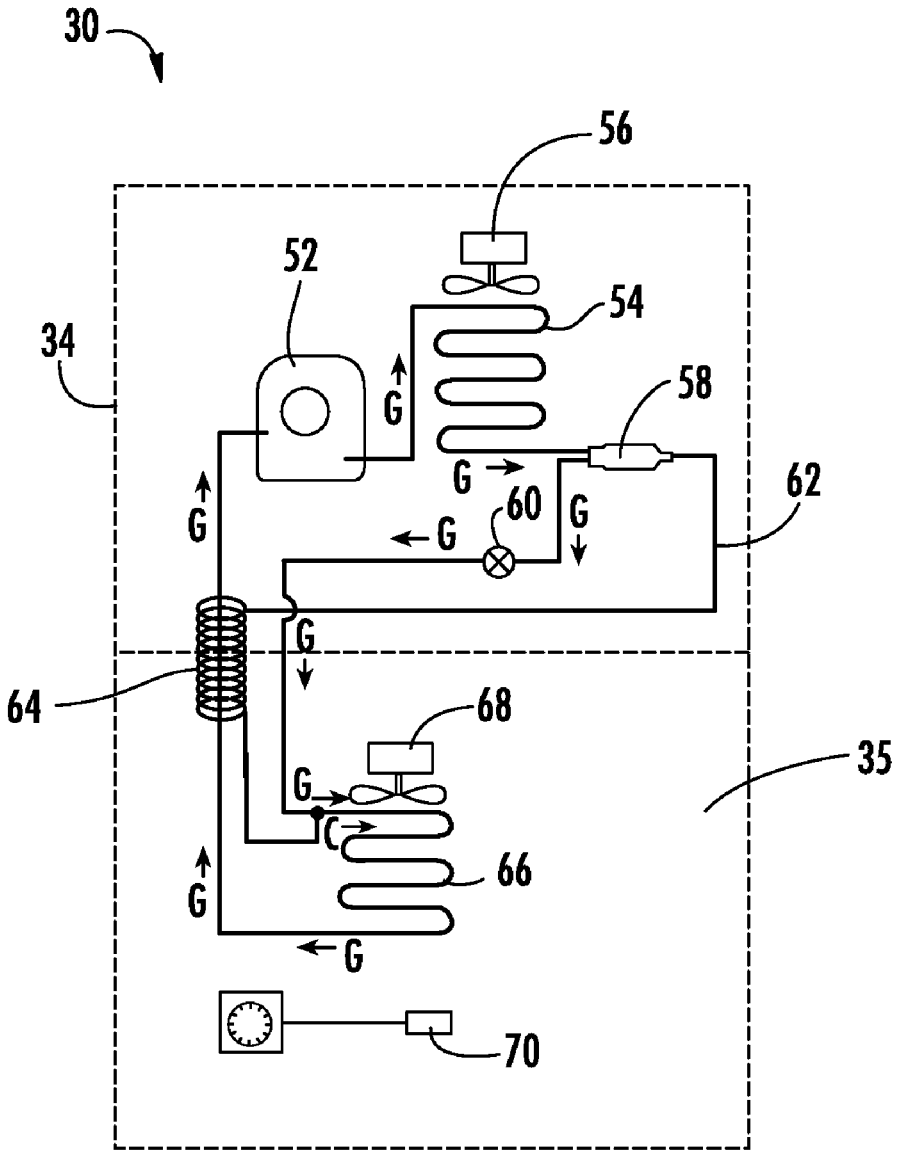
FIG. 3 is a schematic view of a portion of the refrigeration system of FIG. 1.
Figure 4:
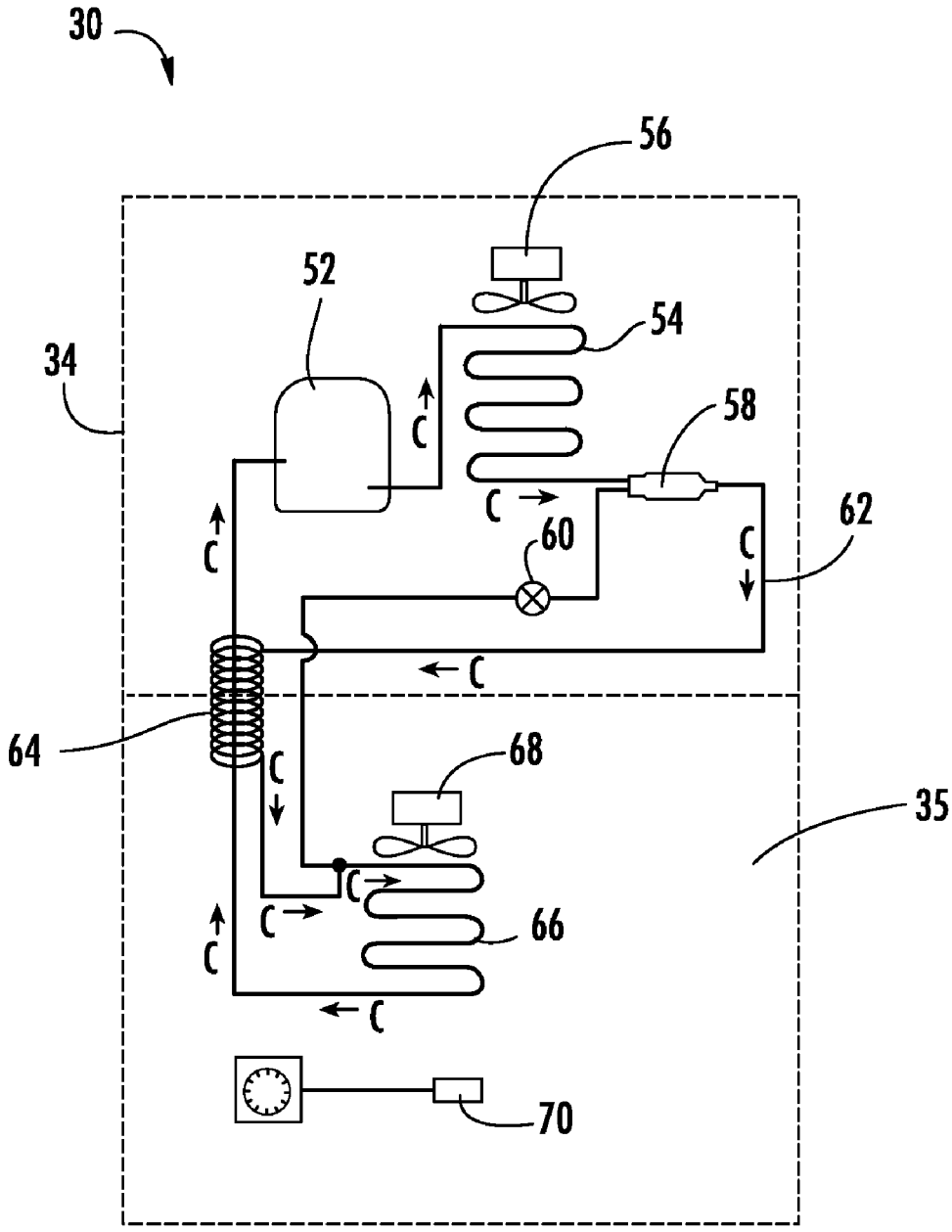
FIG. 4 is a schematic view of a portion of the refrigeration system of FIG. 1.

As shown in FIGS. 2-4, the tubing leading from the capillary tube 62 is connected to a heat exchanger 64. In the embodiment shown, the heat exchanger 64 is essentially a section of coiled tubing. Heat exchangers found effective in the present invention include without limitation those manufactured and sold by Perlick Corp. of Milwaukee, Wis. The tubing leading from the hot gas by-pass valve 60 and heat exchanger 64 join together and are connected to an evaporator 66. The evaporator 66 is preferably positioned in the cooling zone 35. A fan 68, such as those manufactured and sold by EBM Industries, Inc., may be provided to circulate the air inside the cooling zone 35 past the evaporator 66. Evaporators found effective in the present invention include those manufactured and sold by Outokumpu Heatcraft USA, LLC. The evaporator 66 is connected to the compressor 52 via tubing, thereby forming a closed system in which the refrigerant travels. The tubing passes through the heat exchanger 64. A controller 70 is provided to control operation of the compressor system 32. Controllers found effective in the present invention include without limitation those manufactured by Dixell srl of Italy and distributed by Weiss Instruments, Inc. of Holtsville, N.Y. as model number XW60L.

The compressor system 32 operates in at least three modes: refrigeration, hot-gas defrost, and drip. The controller 70 determines the mode of operation of the compressor system 32 based on preset values such as temperature or time. The compressor system 32 operates in refrigeration mode until a preset termination value, such as temperature or time, is met. When such value is met, the controller 70 switches the compressor system 32 to operate in hot-gas defrost mode until a certain preset value, such as temperature or time, is met. Upon meeting this preset value, the compressor system 32 enters the drip mode. The drip mode allows moisture to drip from the evaporator 66 for a predetermined time. When drip mode is completed, the compressor system 32 may enter a recovery period or return to the refrigeration mode.

When operating in refrigeration mode, the compressor system 32 cools the cooling zone(s) 35. In this mode, the compressor system 32 continuously circulates, evaporates, and condenses a fixed supply of refrigerant in a closed system. As shown in FIG. 4, refrigerant travels in direction C from the compressor 52 into the condenser 54 through the drier 58 into the heat exchanger 64 through the evaporator 66 and back to the compressor 52. The refrigerant is in a low pressure gaseous form when it enters the compressor 52. The compressor 52, either during the compression cycle of a variable capacity compressor or while the compressor is operating as a single speed compressor, increases the pressure of the gas refrigerant and discharges high pressure gas into the condenser 54. In the condenser 54, heat is removed from the high pressure gas resulting in the refrigerant condensing into a liquid, still under high pressure. From the condenser 54, the high pressure liquid refrigerant is fed into the drier 58. During the refrigeration mode, by-pass valve 60 is de-energized or closed. Therefore, the high pressure liquid refrigerant is pushed through the drier 58 and into the capillary tube 62. Refrigerant travels through the capillary tube 62, which is part of the heat exchanger 64. The heat exchanger 64, and in one embodiment the capillary tube 62 decreases the pressure of the refrigerant. The refrigerant is a low pressure liquid as it enters the evaporator 66. The refrigerant absorbs heat from the cooling zone 35, and evaporates and expands into a low pressure gas as it travels through the evaporator 66. Refrigerant returns to the compressor 52 in low pressure gaseous form. This concludes one cycle of the refrigeration mode.

During the refrigeration mode, ice or frost may accumulate on the evaporator 66 of the compressor system 32. This accumulation results in decreased performance and efficiency. In the embodiment of the present invention shown in FIGS. 2-4, the compressor system 32 has the ability to melt this accumulation or defrost the compressor system 32. According to the invention, this defrost is accomplished through the use of hot gas. Such hot gas defrost mechanisms are disclosed in U.S. Pat. Nos. 4,979381 to Larson; 3,234,754 to Quick; 3,234,753 to Quick; 3,234,748 to Quick; and 3,645,109 to Quick, all of which are incorporated herein in their entireties for all purposes.

One embodiment of the hot gas defrost mechanism according to the invention is shown in FIG. 3. In this embodiment, when the compressor system 32 operates in hot-gas defrost mode, a fixed supply of medium to high pressure gaseous refrigerant is continuously circulated in the closed system. The by-pass valve 60 is opened thereby allowing the refrigerant to by pass the heat exchanger 64 and thus travel at a higher velocity in the system. Specifically, refrigerant travels in direction G from the compressor 52 through the condenser 54 and into the drier 58. Recall that, in refrigeration mode, the refrigerant is in a low pressure gaseous form when it enters the compressor 52 and is in a high pressure gaseous form when it leaves the compressor 52 to enter the condenser 54, where it is condensed into a high pressure liquid. To the contrary during the hot-gas defrost mode, the condenser 54 does not change the high pressure gas refrigerant into a liquid. The condenser 54 does not change the high pressure gas refrigerant into a liquid because of the relatively high velocity of the gas as it travels through the condenser 54 and the temperature-pressure relationship of the gas relative to the surrounding ambient temperature. The temperature-pressure relationship is such that little to no cooling of the refrigerant occurs.

The gaseous refrigerant is permitted to flow into the drier 58 and then, because the by-pass valve 60 is energized or open, the gaseous refrigerant bypasses the heat exchanger 64 and travels directly to the evaporator 66. The heat from the gaseous refrigerant is transferred to the frost accumulated on the evaporator 66. This heat transfer results in the frost melting and the temperature, and thus the pressure, of the gaseous refrigerant decreasing. The gaseous refrigerant then returns to the compressor 52. This concludes one cycle of the hot-gas defrost mode.

Figure 9:
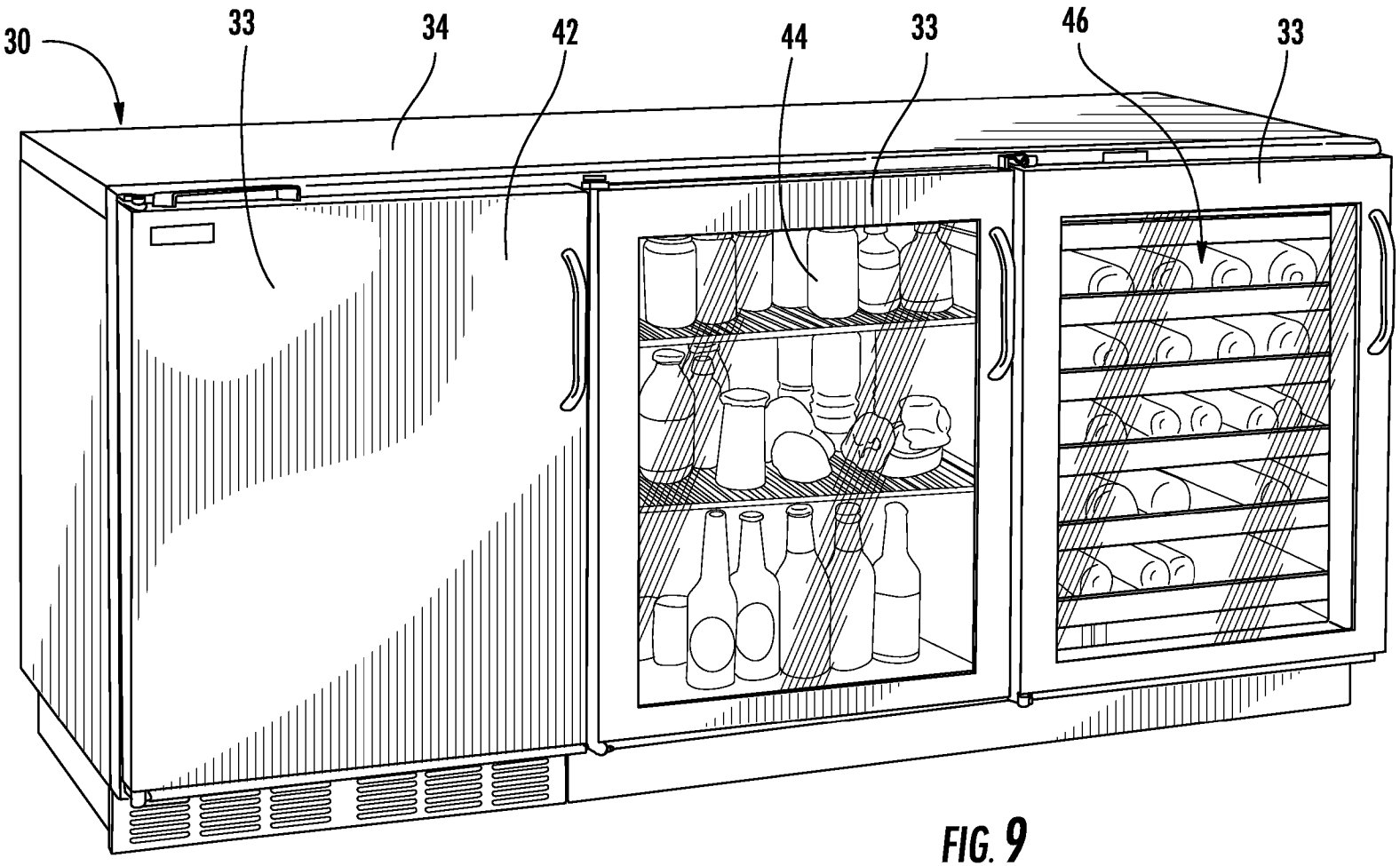
FIG. 9 is a perspective view of a refrigeration system in accordance with one embodiment of the present invention.
Figure 10:
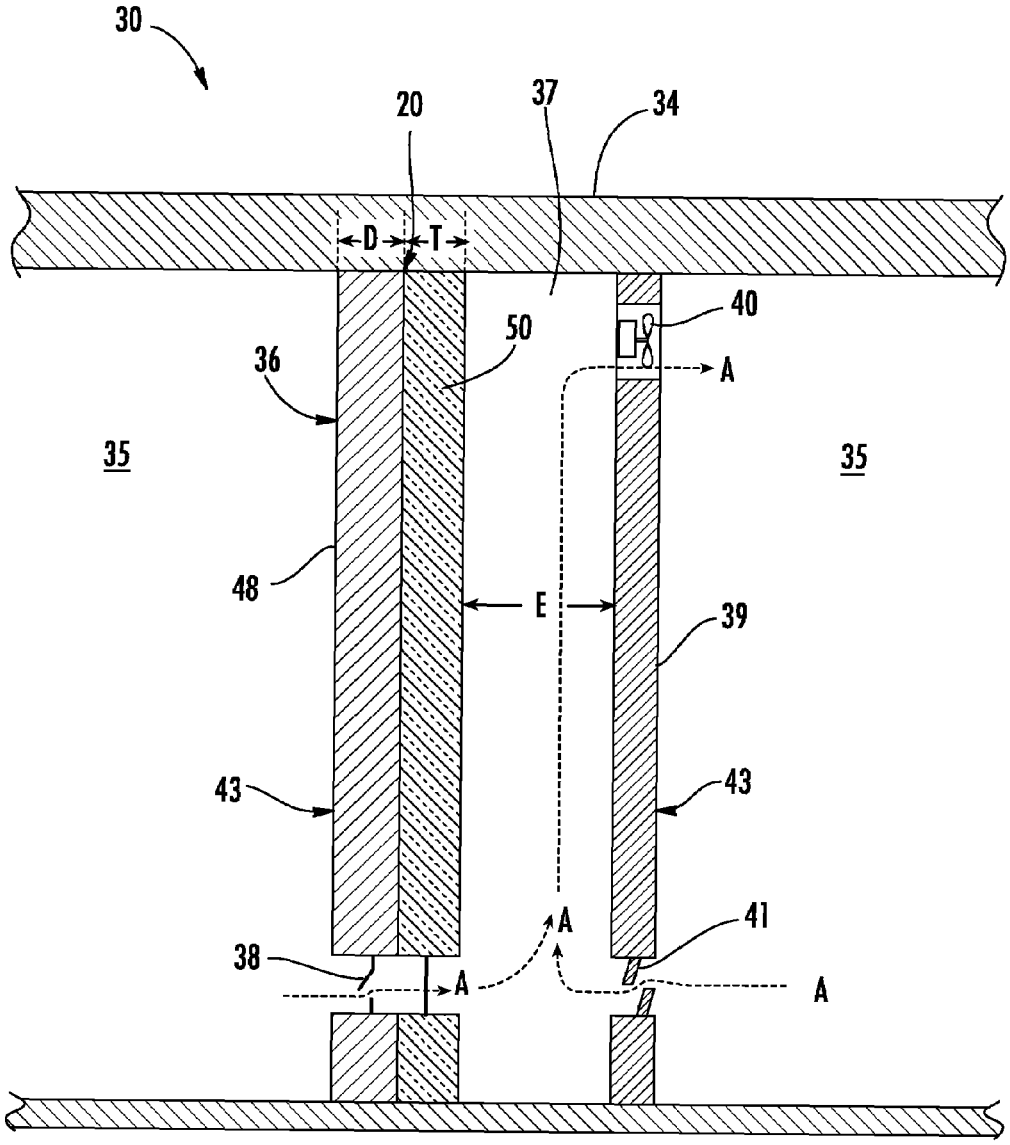
FIG. 10 is a partial cross sectional view of a refrigeration system in accordance with one embodiment of the present invention.

As discussed above and shown in FIGS. 1, 2, 5, 6, 7, and 9, according to one aspect of the invention, the refrigeration system 30 may have more than one cooling zone 35. The cooling zones 35 are separated by a divider 43. The divider 43 may be permanently, removably, or selectably positioned in the refrigeration system 30. In one embodiment, the divider 43 is bracketed in the refrigeration system 30. In the embodiment shown in FIGS. 1 and 10, the divider 43 has a wall. 39 and a partition 36, arranged in generally parallel relation to each other and spaced slightly apart. As shown in FIG. 10, the spacing between wall 39 and partition 36 is a distance E, and the wall and the partition define a heat exchange chamber 37 therebetween. The wall 39 may have a vent or plurality of vents 41 through which air may circulate. A fan or multiple fans 40 may be positioned in communication with the divider 43, such as in an opening provided for the purpose in the wall 39, or otherwise in the cooling zone 35, to facilitate air circulation. Fans found effective in the present invention include without limitation those manufactured and sold by EBM Industries, Inc. For example, as shown in FIGS. 1 and 10, fans 40 may be used to circulate air in a direction A inside the cooling zones 35.

The divider 43 transfers heat from one cooling zone 35 to another. To accomplish this transfer, the partition 36 has a heat transfer panel 20. Any number and configuration of heat transfer panels 20 may be used, depending on the desired performance of the refrigeration system 30. In the embodiment shown in FIG. 10, the heat transfer panel 20 has at least one metal sheet 48, which is preferably a sheet of stainless steel. A heat transfer substance 50 is connected in heat transfer relation to the metal sheet 48. The heat transfer substance 50 may also be engaged to the wall 39 or any other section of the cooling zones 35 of refrigeration system 30. The heat transfer substance 50 may be engaged to metal sheet 48 by any method and is preferably attached to the metal sheet by adhesive. The heat transfer substance 50 may be formed of any type of composition, but is preferably formed of closed cell urethane insulation and most preferably of material sold under the commercial name Armaflex. Both the metal sheet 48 and heat transfer substance 50 may be of varying thicknesses D and T respectively depending on a number of characteristics such as the desired heat transfer from one cooling zone 35 to another cooling zone 35 and the number and temperatures of the cooling zones 35.

Figure 7:
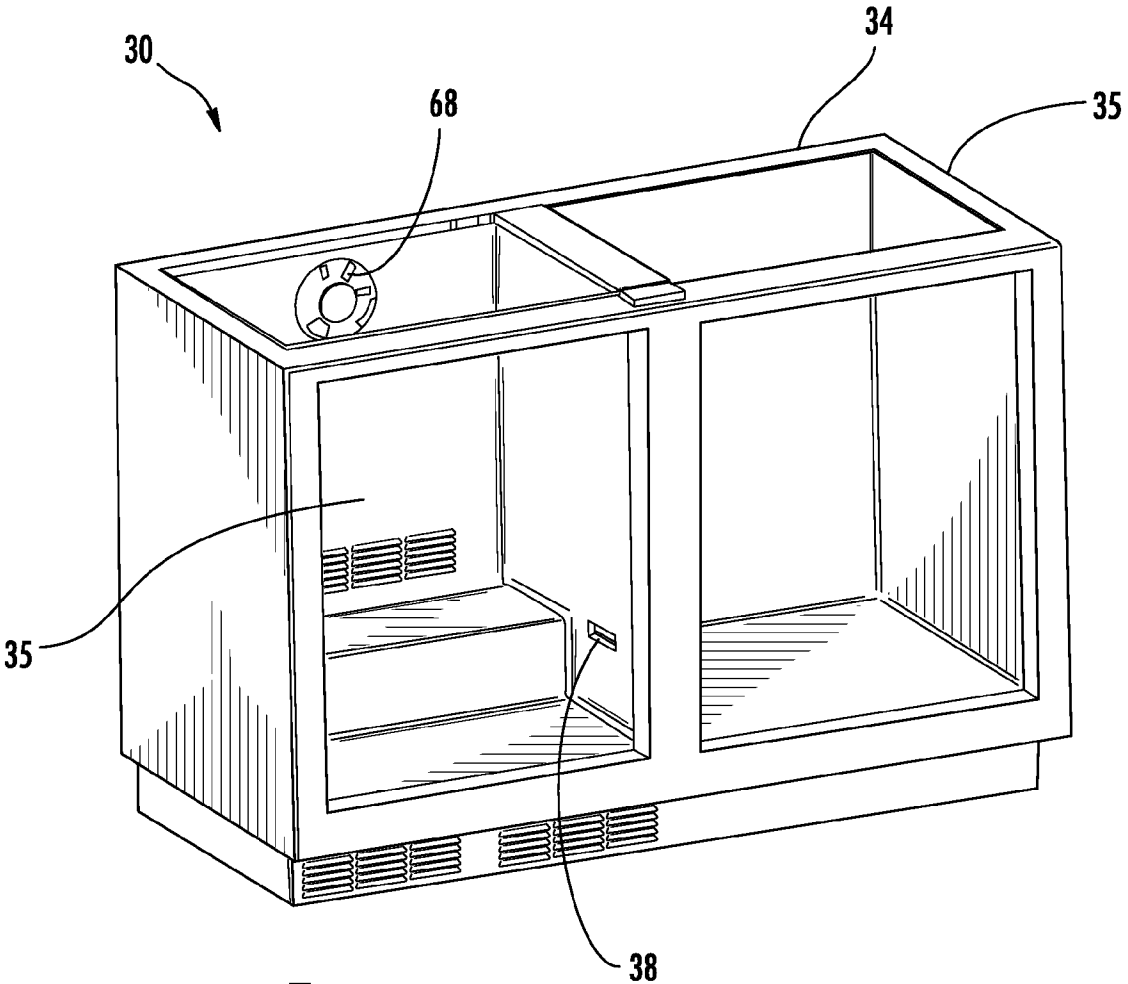
FIG. 7 is a perspective view of a refrigeration system of FIG. 5.

In the embodiments shown in FIGS. 1 and 7, a damper 38 is placed in the divider 43. The damper 38 is preferably integrated into the partition 36. The damper 38 allows air to circulate between different cooling zones 35. Depending on the configuration of the damper 38, air may be allowed to circulate from a colder zone 42 such as a freezer to a warmer zone 44 such as a refrigerator or vice versa. Preferably, the damper 38 selectably controls the circulation of air between the cooling zones 35. The damper 38 may have or be functionally connected to a temperature sensitive control. The control monitors the temperature in a given cooling zone 35. The control signals the damper 38 to circulate air between the cooling zones 35 to achieve a desired temperature. For example, in one embodiment, the damper 38 allows cold air to pass from a colder zone 42 to a warmer zone 44. The damper 38 may be a selectably positionable door or partition, a vent system, a fan, or the like. Dampers found effective in the present invention include without limitation those manufactured and sold by Invensys Appliance Controls of Carol Stream, Ill. as model SK-9019. Such a damper has a panel that pivots between a fully closed position and a position that is open about 90° relative to the fully closed position, thereby regulating the amount of air that passes through the damper.

Figure 5:
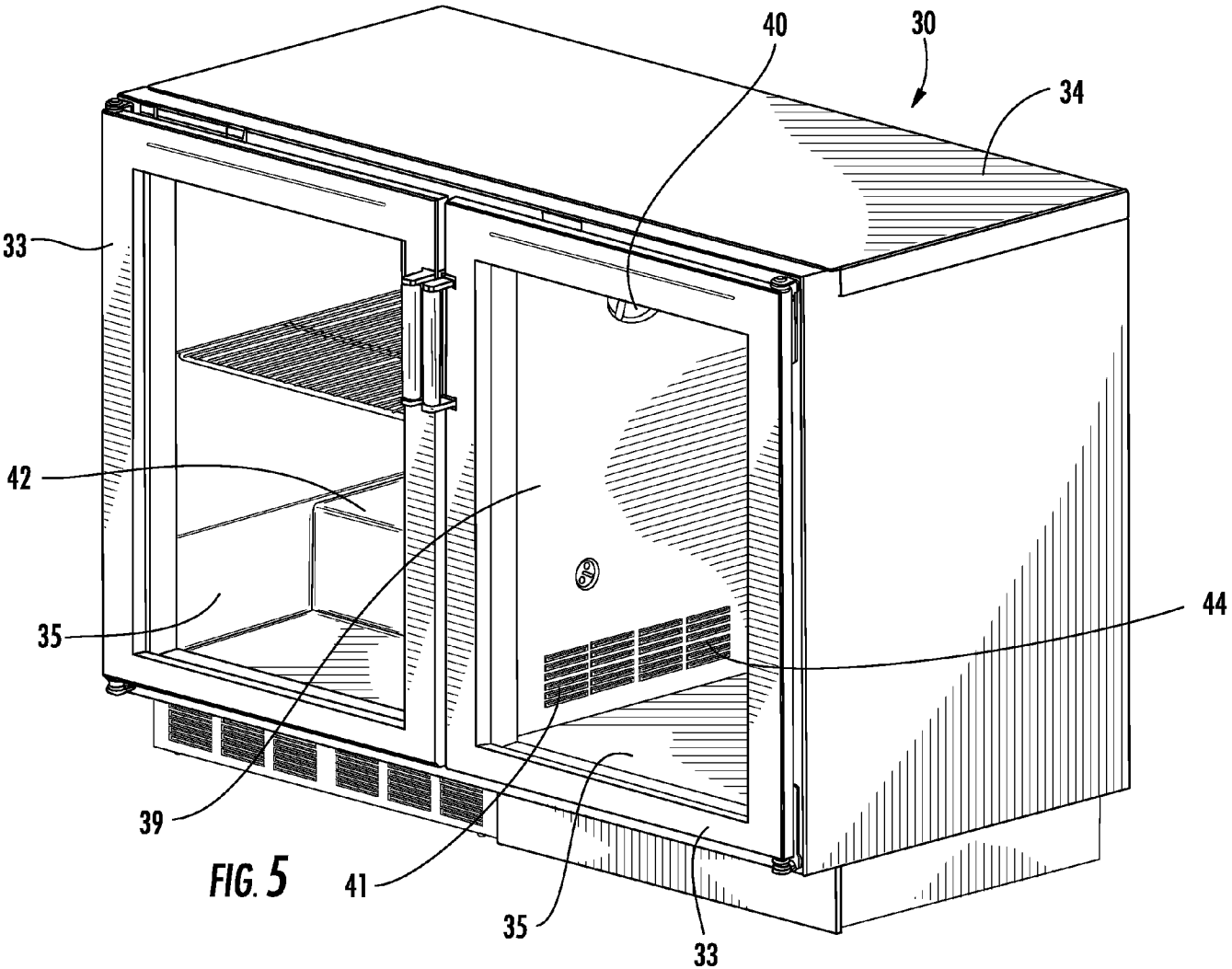
FIG. 5 is a perspective view of a refrigeration system in accordance with one embodiment of the present invention.
Figure 6:
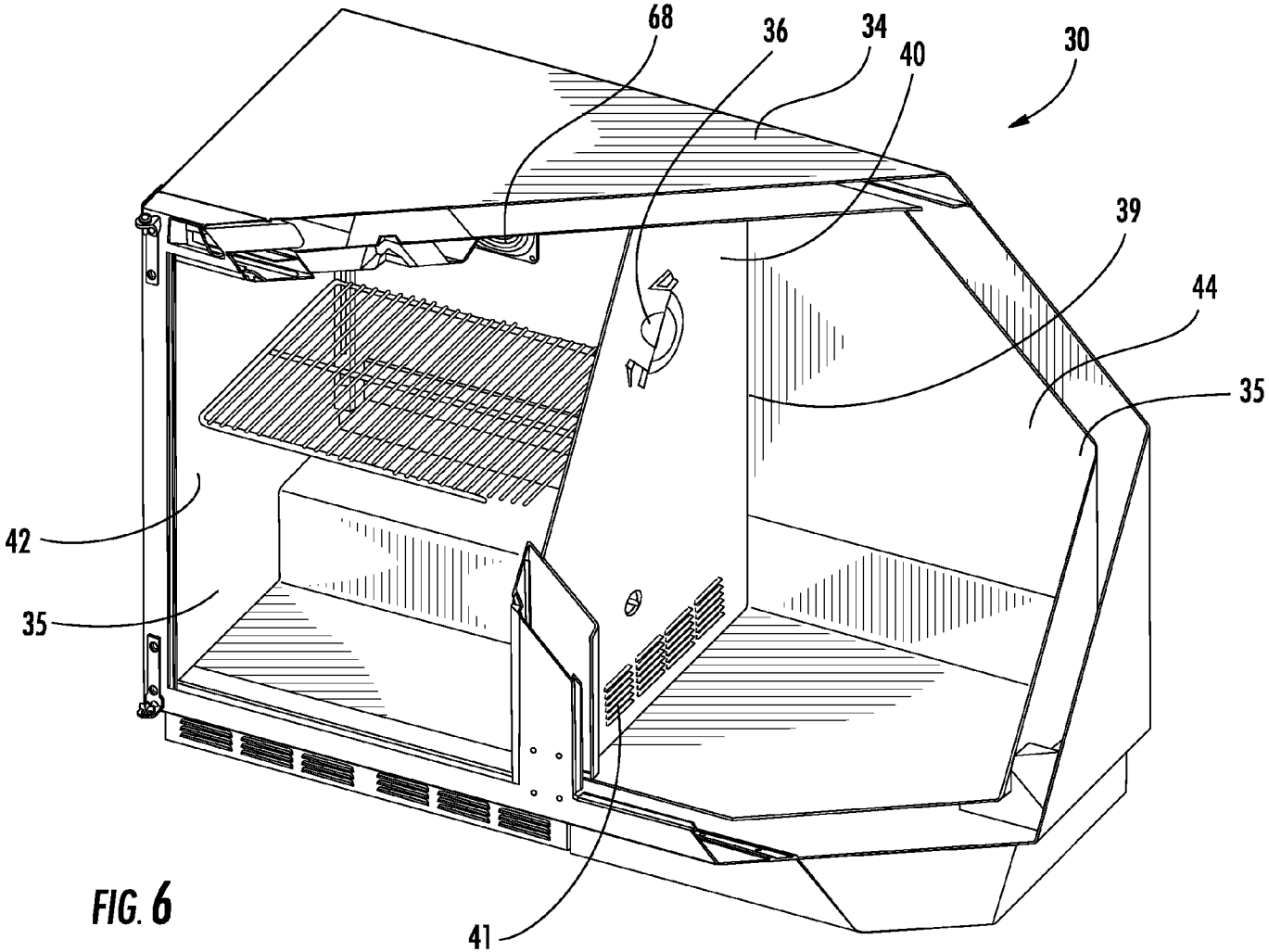
FIG. 6 is a partial cross sectional view of the refrigeration system of FIG. 5.
Figure 8:
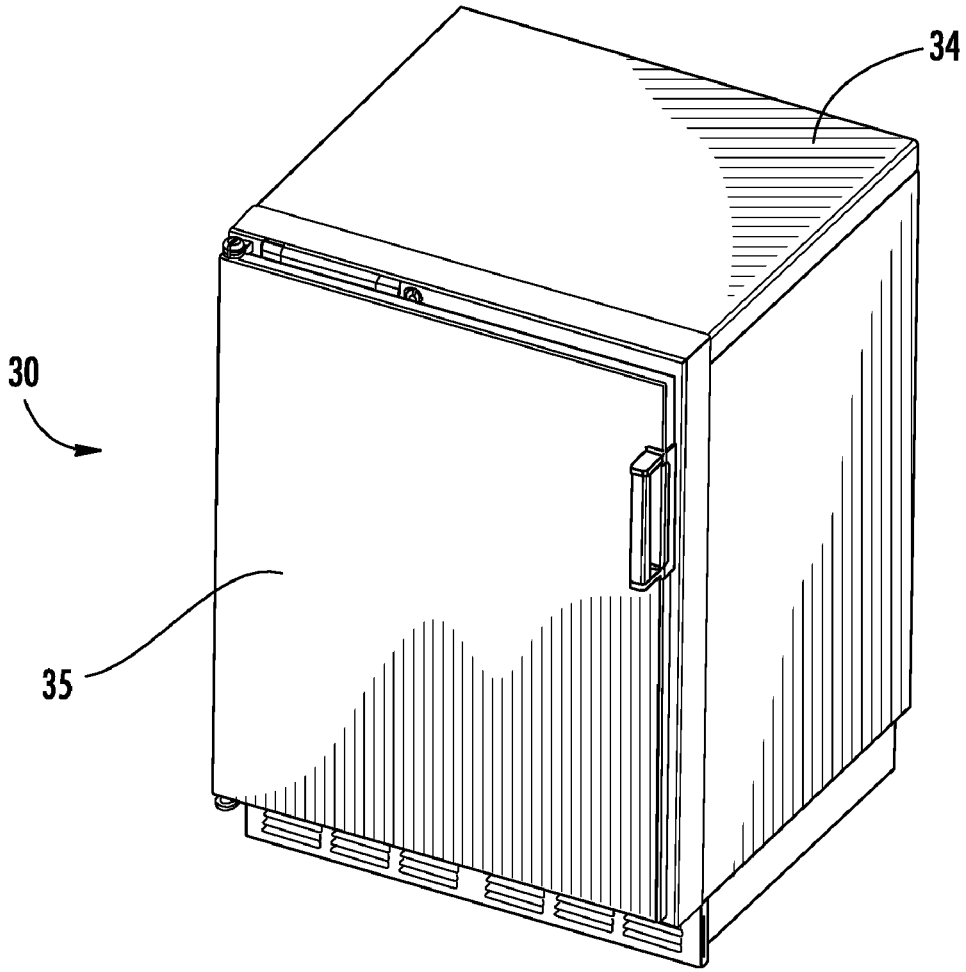
FIG. 8 is a perspective view of a refrigeration system in accordance with one embodiment of the present invention.

The refrigeration system 30 and components thereof of the present invention may be used in a variety of applications. One such application is residential, commercial, and industrial food and beverage cooling. Specifically, the refrigeration system 30 and components thereof of the present invention may be used in refrigeration cabinets 34. As shown in FIGS. 5, 8, and 9, the refrigeration cabinets 34 may have a single cooling zone 35 or multiple cooling zones 35 separated by dividers 43. For example, a refrigeration cabinet 34 with multiple cooling zones 35 may have two zones 35 where one zone is a freezer 42 and the other zone is a refrigerator 44. Alternatively, the refrigeration cabinet 34 may have a freezer 42 and a chiller 46. Further, the refrigeration cabinet 34 may have a refrigerator 44 and a chilling zone 46. In the embodiment shown in FIGS. 1, 2, and 9, the refrigeration cabinet 34 has freezer 42, refrigerator 44, and a chiller 46. The number and relative temperature of the cooling zones 35 may be varied in any number of configurations.

Figure 11:
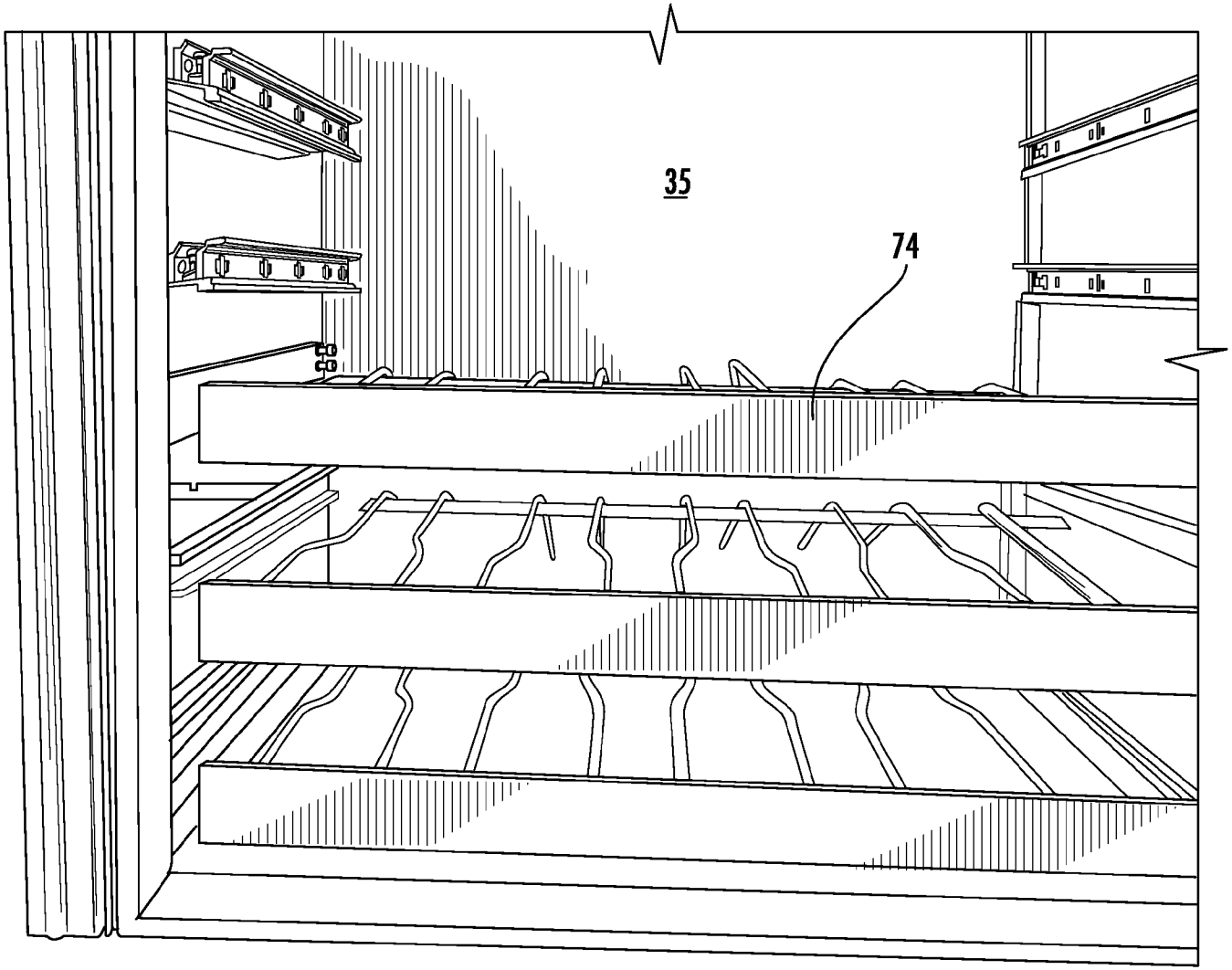
FIG. 11 is a front view of a refrigeration system in accordance with one embodiment of the present invention; and, FIG. 12 is a perspective view of a refrigeration system in accordance with one embodiment of the present invention, shown with a portion of the system removed.
Figure 12:
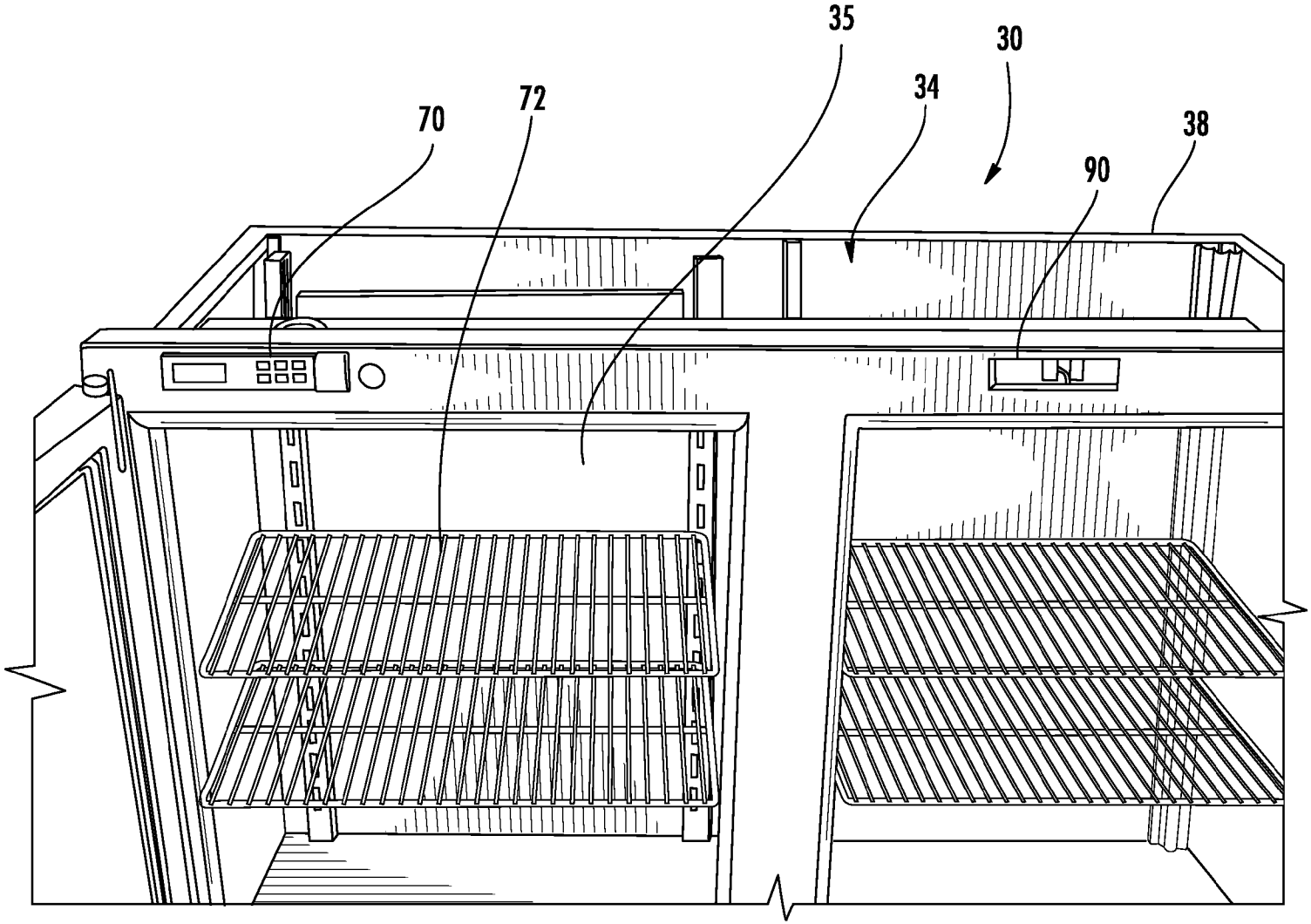

The cabinet 34, and the cooling zones 35 contained therein, may be any shape or size. In one embodiment, the cabinet 34 is designed to fit below a counter or sink. In another embodiment, the cabinet 34 is designed to also function as a bar. The cabinet 34 may be designed to have any finish such as stainless steel, wood, or other finish and to fit into any decor, such as contemporary or traditional. The cabinet 34 may also have any number of doors 33 for accessing a single cooling zone 35 or multiple cooling zones 35. For example as shown in FIG. 9, the cabinet 34 may have three cooling zones 35 with each zone 35 having a single door 33. Each zone 35 may also have multiple doors 33. The doors 33 may be any material or combination thereof. For example as shown in FIG. 9, the doors 33 may be partially or entirely made of glass, metal, wood, or the like. As shown in FIGS. 11 and 12, shelving 72, racks 74, and the like may be permanently or selectably positioned inside the cooling zones 35.

In addition, a single temperature readout 90, or a plurality thereof, may be provided. A readout 90 may be associated with each cooling zone 35. The readouts 90 allow for easy determination of the temperature of a cooling zone 35.

EXAMPLES

The following examples illustrate different performance and physical characteristics of different refrigeration cabinets 34 employing the refrigeration system 30 and components thereof in accordance with the present invention. The refrigeration systems 30 discussed below each have at least two, and sometimes three, cooling zones 35. The cooling zones are separated by at least one divider 43 that has at least one heat exchange panel 20. The heat exchange panels 20 in each example utilize different thicknesses T of the heat transfer substance 50. The tables associated with each example show the performance of specific cabinets 34 in three separate air temperatures outside of the cooling zone 35 (ambient temperature conditions): 70° F., 90° F., and 110° F. Performance is measured as the BTUs/hour required to maintain the desired temperature inside the cooling zones 35. To arrive at this measurement, three values are multiplied together. These values are Delta T, K-Factor, and the material area of the cooling zone 35 in square feet. Delta T is the temperature difference between the ambient temperature conditions and the temperature inside the cooling zone 35. Delta T is measured in degrees Fahrenheit. K-Factor is the measurement used to quantify the resistance to heat transfer of a component of the cabinet 34. K-Factor is measured in BTU/inch/hour/square foot/degree F.

Example 1

The following tables illustrate the performance of a refrigeration cabinet 34 with two cooling zones 35 when the refrigeration cabinet 34 is surrounded by various ambient temperature conditions. In this example, the refrigeration cabinet 34 measures 48 inches by 24 inches by 34 inches. One cooling zone 35 is a freezer 42 maintained between −5° F. and 5° F. The freezer compartment 42 measures 20.5 inches by 20.5 inches by 27 inches. The other cooling zone 35 is a refrigerator 44 maintained between 34° F. and 38° F. The refrigerator compartment measures 20.5 inches by 20.5 inches by 27 inches. The freezer 42 and refrigerator 44 each have a single separate door 33 for access thereto. The freezer 42 and refrigerator 44 are separated by a divider 43 measuring 3 inches thick by 20.5 inches by 27 inches. The divider 43 has a partition 36 with heat transfer panel 20 having a ¾ inch thick heat transfer substance 50. The heat transfer substance 50 is Armaflex.

TABLE 1

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 0.75 | 43 | 0.27 | 60 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 186 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 304 |
| REFRIGERATOR SIDE | | | | | |
| Front (Door)(Length × Height)/144 | 5.08 | 2 | 32 | 0.13 | 11 |

TABLE 1-continued

| 70° F. ambient temperature conditions | | | | | |
|---|---|---|---|---|---|
| Back (Length × Height)/144 | 4.25 | 2 | 32 | 0.13 | 9 |
| Side Rt (Depth × Height)/144 | 5.08 | 2 | 32 | 0.13 | 11 |
| Side Lt (Depth × Height)/144 | 3.84 | 0.75 | −43 | 0.27 | −60 |
| Bottom (Depth × Length)/144 | 4.00 | 2 | 42 | 0.13 | 11 |
| Top (Length × Depth)/144 | 4.00 | 1.5 | 32 | 0.13 | 11 |
| Total Heat Leak Into Cabinet | | | | | −8 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 36 |
| TOTAL CABINET LOAD (BTU/HR) | | | | | 340 |

TABLE 2

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 0.75 | 43 | 0.27 | 60 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 217 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 350 |
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 5.08 | 2 | 52 | 0.13 | 17 |
| Side Lt (Depth × Height)/144 | 3.84 | 0.75 | −43 | 0.27 | −60 |
| Bottom (Depth × Length)/144 | 4.00 | 2 | 62 | 0.13 | 16 |
| Top (Length × Depth)/144 | 4.00 | 1.5 | 52 | 0.13 | 18 |
| Total Heat Leak Into Cabinet | | | | | 23 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 77 |
| TOTAL CABINET LOAD (BTU/HR) | | | | | 428 |

TABLE 3

| 110° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 0.75 | 43 | 0.27 | 60 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 249 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 397 |
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 5.08 | 2 | 72 | 0.13 | 24 |
| Side Lt (Depth × Height)/144 | 3.84 | 0.75 | −43 | 0.27 | −60 |
| Bottom (Depth × Length)/144 | 4.00 | 2 | 82 | 0.13 | 21 |
| Top (Length × Depth)/144 | 4.00 | 1.5 | 72 | 0.13 | 25 |
| Total Heat Leak Into Cabinet | | | | | 54 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 118 |
| TOTAL CABINET LOAD (BTU/HR) | | | | | 515 |

Example 2

The following tables illustrate the performance of a refrigeration cabinet 34 with two cooling zones 35 when the refrigeration cabinet 34 is surrounded by various ambient temperature conditions. This refrigeration cabinet 34 has the same external and internal dimensions as the cabinet of Example 1, except that the heat transfer substance 50 is ½ inch thick Armaflex.

TABLE 4

| 70° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |

TABLE 4-continued

| 70° F. ambient temperature conditions | | | | | |
|---|---|---|---|---|---|
| Side Rt (Depth × Height)/144 | 3.84 | 0.5 | 43 | 0.27 | 89 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 215 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 333 |
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 5.08 | 2 | 32 | 0.13 | 11 |
| Side Lt (Depth × Height)/144 | 3.84 | 0.5 | −43 | 0.27 | −89 |
| Bottom (Depth × Length)/144 | 4.00 | 2 | 42 | 0.13 | 11 |
| Top (Length × Depth)/144 | 4.00 | 1.5 | 32 | 0.13 | 11 |
| Total Heat Leak Into Cabinet | | | | | −37 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 7 |
| TOTAL CABINET LOAD (BTU/HR) | | | | | 340 |

TABLE 5

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 0.5 | 43 | 0.27 | 89 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 247 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 380 |
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 5.08 | 2 | 52 | 0.13 | 17 |
| Side Lt (Depth × Height)/144 | 3.84 | 0.5 | −43 | 0.27 | −89 |
| Bottom (Depth × Length)/144 | 4.00 | 2 | 62 | 0.13 | 16 |

TABLE 5-continued

| 90° F. ambient temperature conditions | | | | | |
|---|---|---|---|---|---|
| Top (Length × Depth)/144 | 4.00 | 1.5 | 52 | 0.13 | 18 |
| Total Heat Leak Into Cabinet | | | | | −6 |
| ALLOWANCE FOR DOOR (BTU/HR) | | | | | 35 |
| FAN INPUT (BTU/HR) | | | | | 19 |
| ALLOWANCE FOR HEATERS * (BTU/HR) | | | | | 0 |
| LIGHT INPUT (BTU/HR) | | | | | 0 |
| Total REFRIGERATOR Load BTU/HR | | | | | 48 |
| TOTAL CABINET LOAD (BTU/HR) | | | | | 428 |

TABLE 6

| 110° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 0.5 | 43 | 0.27 | 89 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 278 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 426 |
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 5.08 | 2 | 72 | 0.13 | 24 |
| Side Lt (Depth × Height)/144 | 3.84 | 0.5 | −43 | 0.27 | −89 |
| Bottom (Depth × Length)/144 | 4.00 | 2 | 82 | 0.13 | 21 |
| Top (Length × Depth)/144 | 4.00 | 1.5 | 72 | 0.13 | 25 |
| Total Heat Leak Into Cabinet | | | | | 24 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 88 |
| TOTAL CABINET LOAD (BTU/HR) | | | | | 515 |

Example 3

The following tables illustrate the performance of a refrigeration cabinet 34 with two cooling zones 35 when the refrigeration cabinet 34 is surrounded by various ambient temperature conditions. This refrigeration cabinet 34 has the same external and internal dimensions as the cabinet of Example 1, except that the heat transfer substance 50 is one inch thick Armaflex.

TABLE 7

| 70° F. ambient temperature | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 1 | 43 | 0.27 | 45 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 171 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 289 |
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 5.08 | 2 | 32 | 0.13 | 11 |
| Side Lt (Depth × Height)/144 | 3.84 | 1 | −43 | 0.27 | −45 |
| Bottom (Depth × Length)/144 | 4.00 | 2 | 42 | 0.13 | 11 |
| Top (Length × Depth)/144 | 4.00 | 1.5 | 32 | 0.13 | 11 |
| Total Heat Leak Into Cabinet | | | | | 7 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 51 |
| TOTAL CABINET LOAD (BTU/HR) | | | | | 340 |

TABLE 8

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 1 | 43 | 0.27 | 45 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 202 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |

TABLE 8-continued

| 90° F. ambient temperature conditions | | | | | |
|---|---|---|---|---|---|
| LIGHT INPUT (BTU/HR) | | | | | 0 |
| Total FREEZER Load BTU/HR | | | | | 335 |
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 5.08 | 2 | 52 | 0.13 | 17 |
| Side Lt (Depth × Height)/144 | 3.84 | 1 | −43 | 0.27 | −45 |
| Bottom (Depth × Length)/144 | 4.00 | 2 | 62 | 0.13 | 16 |
| Top (Length × Depth)/144 | 4.00 | 1.5 | 52 | 0.13 | 18 |
| Total Heat Leak Into Cabinet | | | | | 38 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 92 |
| TOTAL CABINET LOAD (BTU/HR) | | | | | 428 |

TABLE 9

| 110° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 1 | 43 | 0.27 | 45 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 234 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 382 |
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 5.08 | 2 | 72 | 0.13 | 24 |
| Side Lt (Depth × Height)/144 | 3.84 | 1 | −43 | 0.27 | −45 |
| Bottom (Depth × Length)/144 | 4.00 | 2 | 82 | 0.13 | 21 |
| Top (Length × Depth)/144 | 4.00 | 1.5 | 72 | 0.13 | 25 |
| Total Heat Leak Into Cabinet | | | | | 69 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 133 |
| TOTAL CABINET LOAD (BTU/HR) | | | | | 515 |

Example 4

The following tables illustrate the performance of a refrigeration cabinet 34 with two cooling zones 35 when the refrigeration cabinet 34 is surrounded by various ambient temperature conditions. This refrigeration cabinet 34 has the same external and internal dimensions as the cabinet of Example 1, except that this refrigeration cabinet has a refrigerator 44 and a chiller 46 instead of a freezer 43 and a refrigerator 44. The chiller 46 is maintained at about 45° F.

TABLE 10

| 70° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 3.84 | 0.75 | 7 | 0.27 | 10 |
| Side Lt (Depth × Height)/144 | 4.79 | 2 | 32 | 0.13 | 10 |
| Bottom (Depth × Length)/144 | 4.81 | 2 | 52 | 0.13 | 16 |
| Top (Length × Depth)/144 | 4.00 | 1.5 | 32 | 0.13 | 11 |
| Total Heat Leak Into Cabinet | | | | | 66 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 110 |
| CHILLER SIDE | | | | | |
| Front (Door)(Length × Height)/144 | 5.08 | 2 | 25 | 0.13 | 8 |
| Back (Length × Height)/144 | 4.25 | 2 | 25 | 0.13 | 7 |
| Side Rt (Depth × Height)/144 | 5.08 | 2 | 25 | 0.13 | 8 |
| Side Lt (Depth × Height)/144 | 3.84 | 0.75 | −7 | 0.27 | −10 |
| Bottom (Depth × Length)/144 | 4.00 | 2 | 35 | 0.13 | 9 |
| Top (Length × Depth)/144 | 4.00 | 1.5 | 25 | 0.13 | 9 |
| Total Heat Leak Into Cabinet | | | | | 32 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 71 |
| TOTAL CABINET LOAD (BTU/HR) | | | | | 181 |

TABLE 11

| 90° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| REFRIGERATOR SIDE | | | | | |
| Front (Door)(Length × Height)/144 | 5.08 | 2 | 52 | 0.13 | 17 |

TABLE 11-continued

| 90° F. ambient temperature conditions | | | | | |
|---|---|---|---|---|---|
| Back (Length × Height)/144 | 4.25 | 2 | 52 | 0.13 | 14 |
| Side Rt (Depth × Height)/144 | 3.84 | 0.75 | 7 | 0.27 | 10 |
| Side Lt (Depth × Height)/144 | 4.79 | 2 | 52 | 0.13 | 16 |
| Bottom (Depth × Length)/144 | 4.81 | 2 | 72 | 0.13 | 23 |
| Top (Length × Depth)/144 | 4.00 | 1.5 | 52 | 0.13 | 18 |
| Total Heat Leak Into Cabinet | | | | | 98 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total REFRIGERATOR Load BTU/HR | | | | | 231 |
| CHILLER SIDE | | | | | |
| Front (Door)(Length × Height)/144 | 5.08 | 2 | 45 | 0.13 | 15 |
| Back (Length × Height)/144 | 4.25 | 2 | 45 | 0.13 | 12 |
| Side Rt (Depth × Height)/144 | 5.08 | 2 | 45 | 0.13 | 15 |
| Side Lt (Depth × Height)/144 | 3.84 | 0.75 | −7 | 0.27 | −10 |
| Bottom (Depth × Length)/144 | 4.00 | 2 | 55 | 0.13 | 14 |
| Top (Length × Depth)/144 | 4.00 | 1.5 | 45 | 0.13 | 16 |
| Total Heat Leak Into Cabinet | | | | | 62 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 116 |
| TOTAL CABINET LOAD (BTU/HR) | | | | | 347 |

TABLE 12

| 110° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 3.84 | 0.75 | 7 | 0.27 | 10 |
| Side Lt (Depth × Height)/144 | 4.79 | 2 | 72 | 0.13 | 22 |
| Bottom (Depth × Length)/144 | 4.81 | 2 | 92 | 0.13 | 29 |
| Top (Length × Depth)/144 | 4.00 | 1.5 | 72 | 0.13 | 25 |
| Total Heat Leak Into Cabinet | | | | | 130 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total REFRIGERATOR Load BTU/HR | | | | | 278 |
| CHILLER SIDE | | | | | |
| Front (Door)(Length × Height)/144 | 5.08 | 2 | 65 | 0.13 | 21 |
| Back (Length × Height)/144 | 4.25 | 2 | 65 | 0.13 | 18 |
| Side Rt (Depth × Height)/144 | 5.08 | 2 | 65 | 0.13 | 21 |
| Side Lt (Depth × Height)/144 | 3.84 | 0.75 | −7 | 0.27 | −10 |

TABLE 12-continued

| 110° F. ambient temperature conditions | | | | | |
|---|---|---|---|---|---|
| Bottom (Depth × Length)/144 | 4.00 | 2 | 75 | 0.13 | 20 |
| Top (Length × Depth)/144 | 4.00 | 1.5 | 65 | 0.13 | 23 |
| Total Heat Leak Into Cabinet | | | | | 93 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 157 |
| TOTAL CABINET LOAD (BTU/HR) | | | | | 435 |

Example 5

The following tables illustrate the performance of a refrigeration cabinet 34 with two cooling zones 35 when the refrigeration cabinet 34 is surrounded by various ambient temperature conditions. This refrigeration cabinet 34 is essentially the same cabinet of Example 4, except that the heat transfer substance 50 is ½ inch thick Armaflex.

TABLE 13

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 3.84 | 0.5 | 7 | 0.27 | 15 |
| Side Lt (Depth × Height)/144 | 4.79 | 2 | 32 | 0.13 | 10 |
| Bottom (Depth × Length)/144 | 4.81 | 2 | 52 | 0.13 | 16 |
| Top (Length × Depth)/144 | 4.00 | 1.5 | 32 | 0.13 | 11 |
| Total Heat Leak Into Cabinet | | | | | 71 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 115 |
| CHILLER SIDE | | | | | |
| Front (Door)(Length × Height)/144 | 5.08 | 2 | 25 | 0.13 | 8 |
| Back (Length × Height)/144 | 4.25 | 2 | 25 | 0.13 | 7 |
| Side Rt (Depth × Height)/144 | 5.08 | 2 | 25 | 0.13 | 8 |
| Side Lt (Depth × Height)/144 | 3.84 | 0.5 | −7 | 0.27 | −15 |
| Bottom (Depth × Length)/144 | 4.00 | 2 | 35 | 0.13 | 9 |
| Top (Length × Depth)/144 | 4.00 | 1.5 | 25 | 0.13 | 9 |
| Total Heat Leak Into Cabinet | | | | | 27 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 66 |
| TOTAL CABINET LOAD (BTU/HR) | | | | | 181 |

TABLE 14

| 90° F. ambient temperature | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 3.84 | 0.5 | 7 | 0.27 | 15 |
| Side Lt (Depth × Height)/144 | 4.79 | 2 | 52 | 0.13 | 16 |
| Bottom (Depth × Length)/144 | 4.81 | 2 | 72 | 0.13 | 23 |
| Top (Length × Depth)/144 | 4.00 | 1.5 | 52 | 0.13 | 18 |
| Total Heat Leak Into Cabinet | | | | | 103 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total REFRIGERATOR Load BTU/HR | | | | | 236 |
| CHILLER SIDE | | | | | |
| Front (Door)(Length × Height)/144 | 5.08 | 2 | 45 | 0.13 | 15 |
| Back (Length × Height)/144 | 4.25 | 2 | 45 | 0.13 | 12 |
| Side Rt (Depth × Height)/144 | 5.08 | 2 | 45 | 0.13 | 15 |
| Side Lt (Depth × Height)/144 | 3.84 | 0.5 | −7 | 0.27 | −15 |
| Bottom (Depth × Length)/144 | 4.00 | 2 | 55 | 0.13 | 14 |
| Top (Length × Depth)/144 | 4.00 | 1.5 | 45 | 0.13 | 16 |
| Total Heat Leak Into Cabinet | | | | | 58 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 112 |
| TOTAL CABINET LOAD (BTU/HR) | | | | | 347 |

TABLE 15

| 110° F. ambient temperature | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 3.84 | 0.5 | 7 | 0.27 | 15 |
| Side Lt (Depth × Height)/144 | 4.79 | 2 | 72 | 0.13 | 22 |
| Bottom (Depth × Length)/144 | 4.81 | 2 | 92 | 0.13 | 29 |
| Top (Length × Depth)/144 | 4.00 | 1.5 | 72 | 0.13 | 25 |
| Total Heat Leak Into Cabinet | | | | | 134 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |

TABLE 15-continued

| 110° F. ambient temperature | | | | | |
|---|---|---|---|---|---|
| LIGHT INPUT (BTU/HR) | | | | | 0 |
| Total REFRIGERATOR Load BTU/HR | | | | | 282 |
| CHILLER SIDE | | | | | |
| Front (Door)(Length × Height)/144 | 5.08 | 2 | 65 | 0.13 | 21 |
| Back (Length × Height)/144 | 4.25 | 2 | 65 | 0.13 | 18 |
| Side Rt (Depth × Height)/144 | 4.79 | 2 | 65 | 0.13 | 20 |
| Side Lt (Depth × Height)/144 | 3.84 | 0.5 | −7 | 0.27 | −15 |
| Bottom (Depth × Length)/144 | 4.81 | 2 | 75 | 0.13 | 23 |
| Top (Length × Depth)/144 | 4.00 | 1.5 | 65 | 0.13 | 23 |
| Total Heat Leak Into Cabinet | | | | | 91 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 155 |
| TOTAL CABINET LOAD (BTU/HR) | | | | | 438 |

Example 6

The following tables illustrate the performance of a refrigeration cabinet 34 with two cooling zones 35 when the refrigeration cabinet 34 is surrounded by various ambient temperature conditions. This refrigeration cabinet 34 is the same cabinet of Example 4, except that the heat transfer substance 50 is 1 inch thick Armaflex.

TABLE 16

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 3.84 | 1 | 7 | 0.27 | 7 |
| Side Lt (Depth × Height)/144 | 4.79 | 2 | 32 | 0.13 | 10 |
| Bottom (Depth × Length)/144 | 4.81 | 2 | 52 | 0.13 | 16 |
| Top (Length × Depth)/144 | 4.00 | 1.5 | 32 | 0.13 | 11 |
| Total Heat Leak Into Cabinet | | | | | 64 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 108 |
| CHILLER SIDE | | | | | |
| Front (Door)(Length × Height)/144 | 5.08 | 2 | 25 | 0.13 | 8 |
| Back (Length × Height)/144 | 4.25 | 2 | 25 | 0.13 | 7 |
| Side Rt (Depth × Height)/144 | 5.08 | 2 | 25 | 0.13 | 8 |
| Side Lt (Depth × Height)/144 | 3.84 | 1 | −7 | 0.27 | −7 |
| Bottom (Depth × Length)/144 | 4.00 | 2 | 35 | 0.13 | 9 |
| Top (Length × Depth)/144 | 4.00 | 1.5 | 25 | 0.13 | 9 |
| Total Heat Leak Into Cabinet | | | | | 34 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |

TABLE 16-continued

| 70° F. ambient temperature conditions | |
|---|---|
| LIGHT INPUT (BTU/HR) | 0 |
| Total CHILLER Load BTU/HR | 73 |
| TOTAL CABINET LOAD (BTU/HR) | 181 |

TABLE 17

| 90° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 3.84 | 1 | 7 | 0.27 | 7 |
| Side Lt (Depth × Height)/144 | 4.79 | 2 | 52 | 0.13 | 16 |
| Bottom (Depth × Length)/144 | 4.81 | 2 | 72 | 0.13 | 23 |
| Top (Length × Depth)/144 | 4.00 | 1.5 | 52 | 0.13 | 18 |
| Total Heat Leak Into Cabinet | | | | | 96 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total REFRIGERATOR Load BTU/HR | | | | | 229 |
| CHILLER SIDE | | | | | |
| Front (Door)(Length × Height)/144 | 5.08 | 2 | 45 | 0.13 | 15 |
| Back (Length × Height)/144 | 4.25 | 2 | 45 | 0.13 | 12 |
| Side Rt (Depth × Height)/144 | 5.08 | 2 | 45 | 0.13 | 15 |
| Side Lt (Depth × Height)/144 | 3.84 | 1 | −7 | 0.27 | −7 |
| Bottom (Depth × Length)/144 | 4.00 | 2 | 55 | 0.13 | 14 |
| Top (Length × Depth)/144 | 4.00 | 1.5 | 45 | 0.13 | 16 |
| Total Heat Leak Into Cabinet | | | | | 65 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 119 |
| TOTAL CABINET LOAD (BTU/HR) | | | | | 347 |

TABLE 18

| 110° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |

TABLE 18-continued

| 110° F. ambient temperature conditions | | | | | |
|---|---|---|---|---|---|
| Side Rt (Depth × Height)/144 | 3.84 | 1 | 7 | 0.27 | 7 |
| Side Lt (Depth × Height)/144 | 4.79 | 2 | 72 | 0.13 | 22 |
| Bottom (Depth × Length)/144 | 4.81 | 2 | 92 | 0.13 | 29 |
| Top (Length × Depth)/144 | 4.00 | 1.5 | 72 | 0.13 | 25 |
| Total Heat Leak Into Cabinet | | | | | 127 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total REFRIGERATOR Load BTU/HR | | | | | 275 |
| CHILLER SIDE | | | | | |
| Front (Door)(Length × Height)/144 | 5.08 | 2 | 65 | 0.13 | 21 |
| Back (Length × Height)/144 | 4.25 | 2 | 65 | 0.13 | 18 |
| Side Rt (Depth × Height)/144 | 5.08 | 2 | 65 | 0.13 | 21 |
| Side Lt (Depth × Height)/144 | 3.84 | 1 | −7 | 0.27 | −7 |
| Bottom (Depth × Length)/144 | 4.00 | 2 | 75 | 0.13 | 20 |
| Top (Length × Depth)/144 | 4.00 | 1.5 | 65 | 0.13 | 23 |
| Total Heat Leak Into Cabinet | | | | | 96 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 160 |
| TOTAL CABINET LOAD (BTU/HR) | | | | | 435 |

Example 7

The following tables illustrate the performance of a refrigeration cabinet 34 with two cooling zones 35 when the refrigeration cabinet 34 is surrounded by various ambient temperature conditions. This refrigeration cabinet 34 is the same cabinet as Example 4, except that the chiller 46 is maintained at about 65° F.

TABLE 19

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 3.84 | 0.75 | 27 | 0.27 | 37 |
| Side Lt (Depth × Height)/144 | 4.79 | 2 | 32 | 0.13 | 10 |
| Bottom (Depth × Length)/144 | 4.81 | 2 | 52 | 0.13 | 16 |
| Top (Length × Depth)/144 | 4.00 | 1.5 | 32 | 0.13 | 11 |
| Total Heat Leak Into Cabinet | | | | | 94 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 138 |

TABLE 19-continued

| 70° F. ambient temperature conditions | | | | | |
|---|---|---|---|---|---|
| CHILLER SIDE | | | | | |
| Front (Door)(Length × Height)/144 | 5.08 | 2 | 5 | 0.13 | 2 |
| Back (Length × Height)/144 | 4.25 | 2 | 5 | 0.13 | 1 |
| Side Rt (Depth × Height)/144 | 5.08 | 2 | 5 | 0.13 | 2 |
| Side Lt (Depth × Height)/144 | 3.84 | 0.75 | −27 | 0.27 | −37 |
| Bottom (Depth × Length)/144 | 4.00 | 2 | 15 | 0.13 | 4 |
| Top (Length × Depth)/144 | 4.00 | 1.5 | 5 | 0.13 | 2 |
| Total Heat Leak Into Cabinet | | | | | −27 |
| ALLOWANCE FOR DOOR (BTU/HR) | | | | | 10 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 2 |
| TOTAL CABINET LOAD (BTU/HR) | | | | | 140 |

TABLE 20

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 3.84 | 0.75 | 27 | 0.27 | 37 |
| Side Lt (Depth × Height)/144 | 4.79 | 2 | 52 | 0.13 | 16 |
| Bottom (Depth × Length)/144 | 4.81 | 2 | 72 | 0.13 | 23 |
| Top (Length × Depth)/144 | 4.00 | 1.5 | 52 | 0.13 | 18 |
| Total Heat Leak Into Cabinet | | | | | 126 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 180 |
| CHILLER SIDE | | | | | |
| Front (Door)(Length × Height)/144 | 5.08 | 2 | 25 | 0.13 | 8 |
| Back (Length × Height)/144 | 4.25 | 2 | 25 | 0.13 | 7 |
| Side Rt (Depth × Height)/144 | 5.08 | 2 | 25 | 0.13 | 8 |
| Side Lt (Depth × Height)/144 | 3.84 | 0.75 | −27 | 0.27 | −37 |
| Bottom (Depth × Length)/144 | 4.00 | 2 | 35 | 0.13 | 9 |
| Top (Length × Depth)/144 | 4.00 | 1.5 | 25 | 0.13 | 9 |
| Total Heat Leak Into Cabinet | | | | | 4 |
| ALLOWANCE FOR DOOR (BTU/HR) | | | | | 15 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 38 |
| TOTAL CABINET LOAD (BTU/HR) | | | | | 217 |

TABLE 21

| 110° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 3.84 | 0.75 | 27 | 0.27 | 37 |
| Side Lt (Depth × Height)/144 | 4.79 | 2 | 72 | 0.13 | 22 |
| Bottom (Depth × Length)/144 | 4.81 | 2 | 92 | 0.13 | 29 |
| Top (Length × Depth)/144 | 4.00 | 1.5 | 72 | 0.13 | 25 |
| Total Heat Leak Into Cabinet | | | | | 157 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 221 |
| CHILLER SIDE | | | | | |
| Front (Door)(Length × Height)/144 | 5.08 | 2 | 45 | 0.13 | 15 |
| Back (Length × Height)/144 | 4.25 | 2 | 45 | 0.13 | 12 |
| Side Rt (Depth × Height)/144 | 5.08 | 2 | 45 | 0.13 | 15 |
| Side Lt (Depth × Height)/144 | 3.84 | 0.75 | −27 | 0.27 | −37 |
| Bottom (Depth × Length)/144 | 4.00 | 2 | 55 | 0.13 | 14 |
| Top (Length × Depth)/144 | 4.00 | 1.5 | 45 | 0.13 | 16 |
| Total Heat Leak Into Cabinet | | | | | 35 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 74 |
| TOTAL CABINET LOAD (BTU/HR) | | | | | 295 |

Example 8

The following tables illustrate the performance of a refrigeration cabinet 34 with two cooling zones 35 when the refrigeration cabinet 34 is surrounded by various ambient temperature conditions. This refrigeration cabinet 34 is essentially the same cabinet of Example 7, except that the heat transfer substance 50 is ½ inch thick Armaflex.

TABLE 22

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 3.84 | 0.5 | 27 | 0.27 | 56 |
| Side Lt (Depth × Height)/144 | 4.79 | 2 | 32 | 0.13 | 10 |
| Bottom (Depth × Length)/144 | 4.81 | 2 | 52 | 0.13 | 16 |
| Top (Length × Depth)/144 | 4.00 | 1.5 | 32 | 0.13 | 11 |
| Total Heat Leak Into Cabinet | | | | | 113 |
| ALLOWANCE FOR DOOR (BTU/HR) | | | | | 25 |

TABLE 22-continued

| 70° F. ambient temperature conditions | | | | | |
|---|---|---|---|---|---|
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 157 |
| CHILLER SIDE | | | | | |
| Front (Door)(Length × Height)/144 | 5.08 | 2 | 5 | 0.13 | 2 |
| Back (Length × Height)/144 | 4.25 | 2 | 5 | 0.13 | 1 |
| Side Rt (Depth × Height)/144 | 5.08 | 2 | 5 | 0.13 | 2 |
| Side Lt (Depth × Height)/144 | 3.84 | 0.5 | −27 | 0.27 | −56 |
| Bottom (Depth × Length)/144 | 4.00 | 2 | 15 | 0.13 | 4 |
| Top (Length × Depth)/144 | 4.00 | 1.5 | 5 | 0.13 | 2 |
| Total Heat Leak Into Cabinet | | | | | −46 |
| ALLOWANCE FOR DOOR (BTU/HR) | | | | | 10 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | −17 |
| TOTAL CABINET LOAD (BTU/HR) | | | | | 140 |

TABLE 23

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 3.84 | 0.5 | 27 | 0.27 | 56 |
| Side Lt (Depth × Height)/144 | 4.79 | 2 | 52 | 0.13 | 16 |
| Bottom (Depth × Length)/144 | 4.81 | 2 | 72 | 0.13 | 23 |
| Top (Length × Depth)/144 | 4.00 | 1.5 | 52 | 0.13 | 18 |
| Total Heat Leak Into Cabinet | | | | | 144 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 198 |
| CHILLER SIDE | | | | | |
| Front (Door)(Length × Height)/144 | 5.08 | 2 | 25 | 0.13 | 8 |
| Back (Length × Height)/144 | 4.25 | 2 | 25 | 0.13 | 7 |
| Side Rt (Depth × Height)/144 | 5.08 | 2 | 25 | 0.13 | 8 |
| Side Lt (Depth × Height)/144 | 3.84 | 0.5 | −27 | 0.27 | −56 |
| Bottom (Depth × Length)/144 | 4.00 | 2 | 35 | 0.13 | 9 |
| Top (Length × Depth)/144 | 4.00 | 1.5 | 25 | 0.13 | 9 |
| Total Heat Leak Into Cabinet | | | | | −15 |
| ALLOWANCE FOR DOOR (BTU/HR) | | | | | 15 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 19 |
| TOTAL CABINET LOAD (BTU/HR) | | | | | 217 |

TABLE 24

| 110° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 3.84 | 0.5 | 27 | 0.27 | 56 |
| Side Lt (Depth × Height)/144 | 4.79 | 2 | 72 | 0.13 | 22 |
| Bottom (Depth × Length)/144 | 4.81 | 2 | 92 | 0.13 | 29 |
| Top (Length × Depth)/144 | 4.00 | 1.5 | 72 | 0.13 | 25 |
| Total Heat Leak Into Cabinet | | | | | 176 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 240 |
| CHILLER SIDE | | | | | |
| Front (Door)(Length × Height)/144 | 5.08 | 2 | 45 | 0.13 | 15 |
| Back (Length × Height)/144 | 4.25 | 2 | 45 | 0.13 | 12 |
| Side Rt (Depth × Height)/144 | 5.08 | 2 | 45 | 0.13 | 15 |
| Side Lt (Depth × Height)/144 | 3.84 | 0.5 | −27 | 0.27 | −56 |
| Bottom (Depth × Length)/144 | 4.00 | 2 | 55 | 0.13 | 14 |
| Top (Length × Depth)/144 | 4.00 | 1.5 | 45 | 0.13 | 16 |
| Total Heat Leak Into Cabinet | | | | | 16 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 55 |
| TOTAL CABINET LOAD (BTU/HR) | | | | | 295 |

Example 9

The following tables illustrate the performance of a refrigeration cabinet 34 with two cooling zones 35 when the refrigeration cabinet 34 is surrounded by various ambient temperature conditions. This refrigeration cabinet 34 is essentially the same cabinet of Example 7, except that the heat transfer substance 50 is one inch thick Armaflex.

TABLE 25

| 70° F. ambient temperature conditions | | | | | |
|---|---|---|---|---|---|
| MODEL | Length | Depth | Height | Bottom Step | |
| Internal | 44" | 20.5 | 26.5 | 4.875" × 8.625" | |
| External | 48" | 24" | 30.5 | | |
| MODEL (Outside Dimensions) | Sq Ft | Wall Thickness | Delta T | K-Factor | BTU/HR |
| REFRIGERATOR SIDE | | | | | |
| Front (Door)(Length × Height)/144 | 5.08 | 2 | 32 | 0.13 | 11 |
| Back (Length × Height)/144 | 4.25 | 2 | 32 | 0.13 | 9 |
| Side Rt (Depth × Height)/144 | 3.84 | 1 | 27 | 0.27 | 28 |
| Side Lt (Depth × Height)/144 | 4.79 | 2 | 32 | 0.13 | 10 |
| Bottom (Depth × Length)/144 | 4.81 | 2 | 52 | 0.13 | 16 |

TABLE 25-continued

| 70° F. ambient temperature conditions | | | | | |
|---|---|---|---|---|---|
| Top (Length × Depth)/144 | 4.00 | 1.5 | 32 | 0.13 | 11 |
| Total Heat Leak Into Cabinet | | | | | 85 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 129 |
| CHILLER SIDE | | | | | |
| Front (Door)(Length × Height)/144 | 5.08 | 2 | 5 | 0.13 | 2 |
| Back (Length × Height)/144 | 4.25 | 2 | 5 | 0.13 | 1 |
| Side Rt (Depth × Height)/144 | 5.08 | 2 | 5 | 0.13 | 2 |
| Side Lt (Depth × Height)/144 | 3.84 | 1 | −27 | 0.27 | −28 |
| Bottom (Depth × Length)/144 | 4.00 | 2 | 15 | 0.13 | 4 |
| Top (Length × Depth)/144 | 4.00 | 1.5 | 5 | 0.13 | 2 |
| Total Heat Leak Into Cabinet | | | | | −18 |
| ALLOWANCE FOR DOOR (BTU/HR) | | | | | 10 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 11 |
| TOTAL CABINET LOAD (BTU/HR) | | | | | 140 |

TABLE 26

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 52 | 0.13 | 17 |
| Back (Length × Height)/144 | 4.25 | 2 | 52 | 0.13 | 14 |
| Side Rt (Depth × Height)/144 | 3.84 | 1 | 27 | 0.27 | 28 |
| Side Lt (Depth × Height)/144 | 4.79 | 2 | 52 | 0.13 | 16 |
| Bottom (Depth × Length)/144 | 4.81 | 2 | 72 | 0.13 | 23 |
| Top (Length × Depth)/144 | 4.00 | 1.5 | 52 | 0.13 | 18 |
| Total Heat Leak Into Cabinet | | | | | 116 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 170 |
| CHILLER SIDE | | | | | |
| Front (Door)(Length × Height)/144 | 5.08 | 2 | 25 | 0.13 | 8 |
| Back (Length × Height)/144 | 4.25 | 2 | 25 | 0.13 | 7 |
| Side Rt (Depth × Height)/144 | 5.08 | 2 | 25 | 0.13 | 8 |
| Side Lt (Depth × Height)/144 | 3.84 | 1 | −27 | 0.27 | −28 |
| Bottom (Depth × Length)/144 | 4.00 | 2 | 35 | 0.13 | 9 |
| Top (Length × Depth)/144 | 4.00 | 1.5 | 25 | 0.13 | 9 |
| Total Heat Leak Into Cabinet | | | | | 13 |

TABLE 26-continued

| 90° F. ambient temperature conditions | |
|---|---|
| ALLOWANCE FOR DOOR (BTU/HR) | 15 |
| FAN INPUT (BTU/HR) | 19 |
| ALLOWANCE FOR HEATERS *(BTU/HR) | 0 |
| LIGHT INPUT (BTU/HR) | 0 |
| Total CHILLER Load BTU/HR | 47 |
| TOTAL CABINET LOAD (BTU/HR) | 217 |

TABLE 27

110° F. ambient temperature conditions

| MODEL | Length | Depth | Height | Bottom Step |
|---|---|---|---|---|
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| REFRIGERATOR SIDE | | | | | |
| Front (Door)(Length × Height)/144 | 5.08 | 2 | 72 | 0.13 | 24 |
| Back (Length × Height)/144 | 4.25 | 2 | 72 | 0.13 | 20 |
| Side Rt (Depth × Height)/144 | 3.84 | 1 | 27 | 0.27 | 28 |
| Side Lt (Depth × Height)/144 | 4.79 | 2 | 72 | 0.13 | 22 |
| Bottom (Depth × Length)/144 | 4.81 | 2 | 92 | 0.13 | 29 |
| Top (Length × Depth)/144 | 4.00 | 1.5 | 72 | 0.13 | 25 |
| Total Heat Leak Into Cabinet | | | | | 148 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 212 |
| CHILLER SIDE | | | | | |
| Front (Door)(Length × Height)/144 | 5.08 | 2 | 45 | 0.13 | 15 |
| Back (Length × Height)/144 | 4.25 | 2 | 45 | 0.13 | 12 |
| Side Rt (Depth × Height)/144 | 5.08 | 2 | 45 | 0.13 | 15 |
| Side Lt (Depth × Height)/144 | 3.84 | 1 | −27 | 0.27 | −28 |
| Bottom (Depth × Length)/144 | 4.00 | 2 | 55 | 0.13 | 14 |
| Top (Length × Depth)/144 | 4.00 | 1.5 | 45 | 0.13 | 16 |
| Total Heat Leak Into Cabinet | | | | | 44 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 83 |
| TOTAL CABINET LOAD (BTU/HR) | | | | | 295 |

Example 10

The following tables illustrate the performance of a refrigeration cabinet 34 with two cooling zones 35 when the refrigeration cabinet 34 is surrounded by various ambient temperature conditions. The refrigeration cabinet 34 measures 72 inches by 24 inches by 34 inches. One cooling zone 35 is a freezer 42 maintained between −5° F. and 5° F. The freezer 42 measures 20.5 inches by 20.5 inches by 27 inches. The other cooling zone 35 is a refrigerator 44 maintained between 34° F. and 38° F. The refrigerator 44 measures 47.5 inches by 20.5 inches by 27 inches The freezer 42 has a single door 33 and the refrigerator 44 has two doors 33 for access thereto. The freezer 42 and refrigerator 44 are separated by a divider 43 measuring 3 inches by 20.5 inches by 27 inches. The divider 43 has a partition 36 with ¾ inch thick heat transfer substance 50. The heat transfer substance 50 is Armaflex.

TABLE 28

| 70° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 0.75 | 43 | 0.27 | 60 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 186 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 304 |
| REFRIGERATOR SIDE | | | | | |
| Front (Door)(Length × Height)/144 | 10.17 | 2 | 32 | 0.13 | 21 |
| Back (Length × Height)/144 | 10.17 | 2 | 32 | 0.13 | 21 |
| Side Rt (Depth × Height)/144 | 5.08 | 2 | 32 | 0.13 | 11 |
| Side Lt (Depth × Height)/144 | 3.84 | 0.75 | −43 | 0.27 | −60 |
| Bottom (Depth × Length)/144 | 8.00 | 2 | 42 | 0.13 | 22 |
| Top (Length × Depth)/144 | 8.00 | 1.5 | 32 | 0.13 | 22 |
| Total Heat Leak Into Cabinet | | | | | 37 |
| ALLOWANCE FOR DOOR (BTU/HR) | | | | | 50 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 106 |
| TOTAL CABINET LOAD (BTU/HR) | | | | | 410 |

TABLE 29

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 0.75 | 43 | 0.27 | 60 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 217 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |

TABLE 29-continued

| 90° F. ambient temperature conditions | | | | | |
|---|---|---|---|---|---|
| LIGHT INPUT (BTU/HR) | | | | | 0 |
| Total FREEZER Load BTU/HR | | | | | 350 |
| REFRIGERATOR SIDE | | | | | |
| Front (Door)(Length × Height)/144 | 10.17 | 2 | 52 | 0.13 | 34 |
| Back (Length × Height)/144 | 10.17 | 2 | 52 | 0.13 | 34 |
| Side Rt (Depth × Height)/144 | 5.08 | 2 | 52 | 0.13 | 17 |
| Side Lt (Depth × Height)/144 | 3.84 | 0.75 | −43 | 0.27 | −60 |
| Bottom (Depth × Length)/144 | 8.00 | 2 | 62 | 0.13 | 32 |
| Top (Length × Depth)/144 | 8.00 | 1.5 | 52 | 0.13 | 36 |
| Total Heat Leak Into Cabinet | | | | | 95 |
| ALLOWANCE FOR DOOR (BTU/HR) | | | | | 70 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 184 |
| TOTAL CABINET LOAD (BTU/HR) | | | | | 534 |

TABLE 30

| 110° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 0.75 | 43 | 0.27 | 60 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 249 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 397 |
| REFRIGERATOR SIDE | | | | | |
| Front (Door)(Length × Height)/144 | 10.17 | 2 | 72 | 0.13 | 48 |
| Back (Length × Height)/144 | 10.17 | 2 | 72 | 0.13 | 48 |
| Side Rt (Depth × Height)/144 | 5.08 | 2 | 72 | 0.13 | 24 |
| Side Lt (Depth × Height)/144 | 3.84 | 0.75 | −43 | 0.27 | −60 |
| Bottom (Depth × Length)/144 | 8.00 | 2 | 82 | 0.13 | 43 |
| Top (Length × Depth)/144 | 8.00 | 1.5 | 72 | 0.13 | 50 |
| Total Heat Leak Into Cabinet | | | | | 152 |
| ALLOWANCE FOR DOOR (BTU/HR) | | | | | 90 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 261 |
| TOTAL CABINET LOAD (BTU/HR) | | | | | 658 |

Example 11

The following tables illustrate the performance of a refrigeration cabinet 34 with two cooling zones 35 and three doors 33 when the refrigeration cabinet 34 is surrounded by various ambient temperature conditions. This refrigeration cabinet 34 has the same external and internal dimensions as the cabinet of Example 10, except that the heat transfer substance 50 is ½ inch thick Armaflex.

TABLE 31

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 0.5 | 43 | 0.27 | 89 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 215 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 333 |
| REFRIGERATOR SIDE | | | | | |
| Front (Door)(Length × Height)/144 | 10.17 | 2 | 32 | 0.13 | 21 |
| Back (Length × Height)/144 | 10.17 | 2 | 32 | 0.13 | 21 |
| Side Rt (Depth × Height)/144 | 5.08 | 2 | 32 | 0.13 | 11 |
| Side Lt (Depth × Height)/144 | 3.84 | 0.5 | −43 | 0.27 | −89 |
| Bottom (Depth × Length)/144 | 8.00 | 2 | 42 | 0.13 | 22 |
| Top (Length × Depth)/144 | 8.00 | 1.5 | 32 | 0.13 | 22 |
| Total Heat Leak Into Cabinet | | | | | 8 |
| ALLOWANCE FOR DOOR (BTU/HR) | | | | | 50 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 77 |
| TOTAL CABINET LOAD (BTU/HR) | | | | | 410 |

TABLE 32

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 0.5 | 43 | 0.27 | 89 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 247 |
| ALLOWANCE FOR DOOR (BTU/HR) | | | | | 65 |

TABLE 32-continued

| 90° F. ambient temperature conditions | | | | | |
|---|---|---|---|---|---|
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 380 |
| REFRIGERATOR SIDE | | | | | |
| Front (Door)(Length × Height)/144 | 10.17 | 2 | 52 | 0.13 | 34 |
| Back (Length × Height)/144 | 10.17 | 2 | 52 | 0.13 | 34 |
| Side Rt (Depth × Height)/144 | 5.08 | 2 | 52 | 0.13 | 17 |
| Side Lt (Depth × Height)/144 | 3.84 | 0.5 | −43 | 0.27 | −89 |
| Bottom (Depth × Length)/144 | 8.00 | 2 | 62 | 0.13 | 32 |
| Top (Length × Depth)/144 | 8.00 | 1.5 | 52 | 0.13 | 36 |
| Total Heat Leak Into Cabinet | | | | | 65 |
| ALLOWANCE FOR DOOR (BTU/HR) | | | | | 70 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 154 |
| TOTAL CABINET LOAD (BTU/HR) | | | | | 534 |

TABLE 33

| 110° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 0.5 | 43 | 0.27 | 89 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 278 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 426 |
| REFRIGERATOR SIDE | | | | | |
| Front (Door)(Length × Height)/144 | 10.17 | 2 | 72 | 0.13 | 48 |
| Back (Length × Height)/144 | 10.17 | 2 | 72 | 0.13 | 48 |
| Side Rt (Depth × Height)/144 | 5.08 | 2 | 72 | 0.13 | 24 |
| Side Lt (Depth × Height)/144 | 3.84 | 0.5 | −43 | 0.27 | −89 |
| Bottom (Depth × Length)/144 | 8.00 | 2 | 82 | 0.13 | 43 |
| Top (Length × Depth)/144 | 8.00 | 1.5 | 72 | 0.13 | 50 |
| Total Heat Leak Into Cabinet | | | | | 122 |
| ALLOWANCE FOR DOOR (BTU/HR) | | | | | 90 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 231 |
| TOTAL CABINET LOAD (BTU/HR) | | | | | 658 |

Example 12

The following tables illustrate the performance of a refrigeration cabinet 34 with two cooling zones 35 and three doors 33 when the refrigeration cabinet 34 is surrounded by various ambient temperature conditions. This refrigeration cabinet 34 has the same external and internal dimensions as the cabinet of Example 10, except that the heat transfer substance 50 is one inch thick Armaflex.

TABLE 34

| 70° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 1 | 43 | 0.27 | 45 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 171 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 289 |
| REFRIGERATOR SIDE | | | | | |
| Front (Door)(Length × Height)/144 | 10.17 | 2 | 32 | 0.13 | 21 |
| Back (Length × Height)/144 | 10.17 | 2 | 32 | 0.13 | 21 |
| Side Rt (Depth × Height)/144 | 5.08 | 2 | 32 | 0.13 | 11 |
| Side Lt (Depth × Height)/144 | 3.84 | 1 | −43 | 0.27 | −45 |
| Bottom (Depth × Length)/144 | 8.00 | 2 | 42 | 0.13 | 22 |
| Top (Length × Depth)/144 | 8.00 | 1.5 | 32 | 0.13 | 22 |
| Total Heat Leak Into Cabinet | | | | | 52 |
| ALLOWANCE FOR DOOR (BTU/HR) | | | | | 50 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 121 |
| TOTAL CABINET LOAD (BTU/HR) | | | | | 410 |

TABLE 35

| 90° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 1 | 43 | 0.27 | 45 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 202 |
| ALLOWANCE FOR DOOR (BTU/HR) | | | | | 65 |

TABLE 35-continued

| 90° F. ambient temperature conditions | | | | | |
|---|---|---|---|---|---|
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 335 |
| REFRIGERATOR SIDE | | | | | |
| Front (Door)(Length × Height)/144 | 10.17 | 2 | 52 | 0.13 | 34 |
| Back (Length × Height)/144 | 10.17 | 2 | 52 | 0.13 | 34 |
| Side Rt (Depth × Height)/144 | 5.08 | 2 | 52 | 0.13 | 17 |
| Side Lt (Depth × Height)/144 | 3.84 | 1 | −43 | 0.27 | −45 |
| Bottom (Depth × Length)/144 | 8.00 | 2 | 62 | 0.13 | 32 |
| Top (Length × Depth)/144 | 8.00 | 1.5 | 52 | 0.13 | 36 |
| Total Heat Leak Into Cabinet | | | | | 110 |
| ALLOWANCE FOR DOOR (BTU/HR) | | | | | 70 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 199 |
| TOTAL CABINET LOAD (BTU/HR) | | | | | 534 |

TABLE 36

| 110° F. ambient temperature conditions | | | | |
|---|---|---|---|---|
| MODEL | Length | Depth | Height | Bottom Step |
| Internal | 44" | 20.5 | 26.5 | 4.875" × 8.625" |
| External | 48" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 1 | 43 | 0.27 | 45 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 234 |
| ALLOWANCE FOR DOOR (BTU/HR) | | | | | 80 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 382 |
| REFRIGERATOR SIDE | | | | | |
| Front (Door)(Length × Height)/144 | 10.17 | 2 | 72 | 0.13 | 48 |
| Back (Length × Height)/144 | 10.17 | 2 | 72 | 0.13 | 48 |
| Side Rt (Depth × Height)/144 | 5.08 | 2 | 72 | 0.13 | 24 |
| Side Lt (Depth × Height)/144 | 3.84 | 1 | −43 | 0.27 | −45 |
| Bottom (Depth × Length)/144 | 8.00 | 2 | 82 | 0.13 | 43 |
| Top (Length × Depth)/144 | 8.00 | 1.5 | 72 | 0.13 | 50 |
| Total Heat Leak Into Cabinet | | | | | 167 |
| ALLOWANCE FOR DOOR (BTU/HR) | | | | | 90 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 276 |
| TOTAL CABINET LOAD (BTU/HR) | | | | | 658 |

Example 13

The following tables illustrate the performance of a refrigeration cabinet 34 with three cooling zones 35 and three doors 33 when the refrigeration cabinet 34 is surrounded by various ambient temperature conditions. The refrigeration cabinet 34 measures 72 inches by 24 inches by 34 inches. One cooling zone 35 is a freezer 42 maintained between −5° F. and 5° F. The freezer 42 measures 20.5 inches by 20.5 inches by 27 inches; The next cooling zone 35 is a refrigerator 44 maintained between 34° F. and 38° F. The refrigerator 44 measures 47.5 inches by 20.5 inches by 27 inches. The final cooling zone is a chiller 46 maintained between 45° F. and 65° F. The freezer 42, refrigerator 44, and chiller 46 each have a single door 33 for access thereto. The freezer 42 and refrigerator 44 and the refrigerator 44 and chiller 46 are separated by dividers 43. The dividers 43 measure 3 inches by 20.5 inches by 27 inches. The dividers 43 have a partition 36 with ¾ inch thick heat transfer substance 50. The heat transfer substance 50 is Armaflex.

TABLE 37

| 70° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 0.75 | 43 | 0.27 | 60 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 186 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 304 |
| REFRIGERATOR SIDE | | | | | |
| Front (Door)(Length × Height)/144 | 4.45 | 2 | 32 | 0.13 | 9 |
| Back (Length × Height)/144 | 4.45 | 2 | 32 | 0.13 | 9 |
| Side Rt (Depth × Height)/144 | 3.84 | 0.75 | 7 | 0.13 | 5 |
| Side Lt (Depth × Height)/144 | 3.84 | 0.75 | −43 | 0.27 | −60 |
| Bottom (Depth × Length)/144 | 3.50 | 2 | 42 | 0.13 | 10 |
| Top (Length × Depth)/144 | 3.50 | 1.5 | 32 | 0.13 | 10 |
| Total Heat Leak Into Cabinet | | | | | −17 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 27 |
| CHILLER SIDE | | | | | |
| Front (Door)(Length × Height)/144 | 4.34 | 2 | 25 | 0.13 | 7 |
| Back (Length × Height)/144 | 4.34 | 2 | 25 | 0.13 | 7 |
| Side Rt (Depth × Height)/144 | 5.08 | 2 | 25 | 0.13 | 8 |
| Side Lt (Depth × Height)/144 | 3.84 | 0.75 | −7 | 0.27 | −10 |
| Bottom (Depth × Length)/144 | 3.75 | 2 | 35 | 0.13 | 9 |
| Top (Length × Depth)/144 | 3.75 | 1.5 | 25 | 0.13 | 8 |
| Total Heat Leak Into Cabinet | | | | | 29 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 68 |
| TOTAL CABINET LOAD (BTU/HR) | | | | | 399 |

TABLE 38

| 90° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 0.75 | 43 | 0.27 | 60 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 217 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 350 |
| REFRIGERATOR SIDE | | | | | |
| Front (Door)(Length × Height)/144 | 4.45 | 2 | 52 | 0.13 | 15 |
| Back (Length × Height)/144 | 4.45 | 2 | 52 | 0.13 | 15 |
| Side Rt (Depth × Height)/144 | 3.84 | 0.75 | 7 | 0.13 | 5 |
| Side Lt (Depth × Height)/144 | 3.84 | 0.75 | −43 | 0.27 | −60 |
| Bottom (Depth × Length)/144 | 3.50 | 2 | 62 | 0.13 | 14 |
| Top (Length × Depth)/144 | 3.50 | 1.5 | 52 | 0.13 | 16 |
| Total Heat Leak Into Cabinet | | | | | 5 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 59 |
| CHILLER SIDE | | | | | |
| Front (Door)(Length × Height)/144 | 4.34 | 2 | 45 | 0.13 | 13 |
| Back (Length × Height)/144 | 4.34 | 2 | 45 | 0.13 | 13 |
| Side Rt (Depth × Height)/144 | 5.08 | 2 | 45 | 0.13 | 15 |
| Side Lt (Depth × Height)/144 | 3.84 | 0.75 | −7 | 0.27 | −10 |
| Bottom (Depth × Length)/144 | 3.75 | 2 | 55 | 0.13 | 13 |
| Top (Length × Depth)/144 | 3.75 | 1.5 | 45 | 0.13 | 15 |
| Total Heat Leak Into Cabinet | | | | | 59 |
| ALLOWANCE FOR DOOR (BTU/HR) | | | | | 30 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 108 |
| TOTAL CABINET LOAD (BTU/HR) | | | | | 517 |

TABLE 39

| 110° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 0.75 | 43 | 0.27 | 60 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 249 |
| ALLOWANCE FOR DOOR (BTU/HR) | | | | | 75 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 392 |
| REFRIGERATOR SIDE | | | | | |
| Front (Door)(Length × Height)/144 | 4.45 | 2 | 72 | 0.13 | 21 |
| Back (Length × Height)/144 | 4.45 | 2 | 72 | 0.13 | 21 |
| Side Rt (Depth × Height)/144 | 3.84 | 0.75 | 7 | 0.13 | 5 |
| Side Lt (Depth × Height)/144 | 3.84 | 0.75 | −43 | 0.27 | −60 |
| Bottom (Depth × Length)/144 | 3.50 | 2 | 82 | 0.13 | 19 |
| Top (Length × Depth)/144 | 3.50 | 1.5 | 72 | 0.13 | 22 |
| Total Heat Leak Into Cabinet | | | | | 27 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 91 |
| CHILLER SIDE | | | | | |
| Front (Door)(Length × Height)/144 | 4.34 | 2 | 65 | 0.13 | 18 |
| Back (Length × Height)/144 | 4.34 | 2 | 65 | 0.13 | 18 |
| Side Rt (Depth × Height)/144 | 5.08 | 2 | 65 | 0.13 | 21 |
| Side Lt (Depth × Height)/144 | 3.84 | 0.75 | −7 | 0.27 | −10 |
| Bottom (Depth × Length)/144 | 3.75 | 2 | 75 | 0.13 | 18 |
| Top (Length × Depth)/144 | 3.75 | 1.5 | 65 | 0.13 | 21 |
| Total Heat Leak Into Cabinet | | | | | 88 |
| ALLOWANCE FOR DOOR (BTU/HR) | | | | | 40 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 147 |
| TOTAL CABINET LOAD (BTU/HR) | | | | | 630 |

Example 14

The following tables illustrate the performance of a refrigeration cabinet 34 with three cooling zones 35 and three doors 33 when the refrigeration cabinet 34 is surrounded by various ambient temperature conditions. This refrigeration cabinet 34 has the same external and internal dimensions as the cabinet of Example 13, except that the heat transfer substance 50 is ½ inch thick Armaflex.

TABLE 40

| 70° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 0.5 | 43 | 0.27 | 89 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 215 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 333 |
| REFRIGERATOR SIDE | | | | | |
| Front (Door)(Length × Height)/144 | 4.45 | 2 | 32 | 0.13 | 9 |
| Back (Length × Height)/144 | 4.45 | 2 | 32 | 0.13 | 9 |
| Side Rt (Depth × Height)/144 | 3.84 | 0.5 | 7 | 0.13 | 7 |
| Side Lt (Depth × Height)/144 | 3.84 | 0.5 | −43 | 0.27 | −89 |
| Bottom (Depth × Length)/144 | 3.50 | 2 | 42 | 0.13 | 10 |
| Top (Length × Depth)/144 | 3.50 | 1.5 | 32 | 0.13 | 10 |
| Total Heat Leak Into Cabinet | | | | | −44 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 0 |
| CHILLER SIDE | | | | | |
| Front (Door)(Length × Height)/144 | 4.34 | 2 | 25 | 0.13 | 7 |
| Back (Length × Height)/144 | 4.34 | 2 | 25 | 0.13 | 7 |
| Side Rt (Depth × Height)/144 | 5.08 | 2 | 25 | 0.13 | 8 |
| Side Lt (Depth × Height)/144 | 3.84 | 0.5 | −7 | 0.27 | −15 |
| Bottom (Depth × Length)/144 | 3.75 | 2 | 35 | 0.13 | 9 |
| Top (Length × Depth)/144 | 3.75 | 1.5 | 25 | 0.13 | 8 |
| Total Heat Leak Into Cabinet | | | | | 24 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 63 |
| TOTAL CABINET LOAD (BTU/HR) | | | | | 396 |

TABLE 41

| 90° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 0.5 | 43 | 0.27 | 89 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 247 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 380 |
| REFRIGERATOR SIDE | | | | | |
| Front (Door)(Length × Height)/144 | 4.45 | 2 | 52 | 0.13 | 15 |
| Back (Length × Height)/144 | 4.45 | 2 | 52 | 0.13 | 15 |
| Side Rt (Depth × Height)/144 | 3.84 | 0.5 | 7 | 0.13 | 7 |
| Side Lt (Depth × Height)/144 | 3.84 | 0.5 | −43 | 0.27 | −89 |
| Bottom (Depth × Length)/144 | 3.50 | 2 | 62 | 0.13 | 14 |
| Top (Length × Depth)/144 | 3.50 | 1.5 | 52 | 0.13 | 16 |
| Total Heat Leak Into Cabinet | | | | | −22 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 32 |
| CHILLER SIDE | | | | | |
| Front (Door)(Length × Height)/144 | 4.34 | 2 | 45 | 0.13 | 13 |
| Back (Length × Height)/144 | 4.34 | 2 | 45 | 0.13 | 13 |
| Side Rt (Depth × Height)/144 | 5.08 | 2 | 45 | 0.13 | 15 |
| Side Lt (Depth × Height)/144 | 3.84 | 0.5 | −7 | 0.27 | −15 |
| Bottom (Depth × Length)/144 | 3.75 | 2 | 55 | 0.13 | 13 |
| Top (Length × Depth)/144 | 3.75 | 1.5 | 45 | 0.13 | 15 |
| Total Heat Leak Into Cabinet | | | | | 54 |
| ALLOWANCE FOR DOOR (BTU/HR) | | | | | 30 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 103 |
| TOTAL CABINET LOAD (BTU/HR) | | | | | 514 |

TABLE 42

| 110° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 0.5 | 43 | 0.27 | 89 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 278 |
| ALLOWANCE FOR DOOR (BTU/HR) | | | | | 75 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 421 |
| REFRIGERATOR SIDE | | | | | |
| Front (Door)(Length × Height)/144 | 4.45 | 2 | 72 | 0.13 | 21 |
| Back (Length × Height)/144 | 4.45 | 2 | 72 | 0.13 | 21 |
| Side Rt (Depth × Height)/144 | 3.84 | 0.5 | 7 | 0.13 | 7 |
| Side Lt (Depth × Height)/144 | 3.84 | 0.5 | −43 | 0.27 | −89 |
| Bottom (Depth × Length)/144 | 3.50 | 2 | 82 | 0.13 | 19 |
| Top (Length × Depth)/144 | 3.50 | 1.5 | 72 | 0.13 | 22 |
| Total Heat Leak Into Cabinet | | | | | 0 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 64 |
| CHILLER SIDE | | | | | |
| Front (Door)(Length × Height)/144 | 4.34 | 2 | 65 | 0.13 | 18 |
| Back (Length × Height)/144 | 4.34 | 2 | 65 | 0.13 | 18 |
| Side Rt (Depth × Height)/144 | 5.08 | 2 | 65 | 0.13 | 21 |
| Side Lt (Depth × Height)/144 | 3.84 | 0.5 | −7 | 0.27 | −15 |
| Bottom (Depth × Length)/144 | 3.75 | 2 | 75 | 0.13 | 18 |
| Top (Length × Depth)/144 | 3.75 | 1.5 | 65 | 0.13 | 21 |
| Total Heat Leak Into Cabinet | | | | | 83 |
| ALLOWANCE FOR DOOR (BTU/HR) | | | | | 40 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 142 |
| TOTAL CABINET LOAD (BTU/HR) | | | | | 627 |

Example 15

The following tables illustrate the performance of a refrigeration cabinet 34 with three cooling zones 35 and three doors 33 when the refrigeration cabinet 34 is surrounded by various ambient temperature conditions. This refrigeration cabinet 34 has the same external and internal dimensions as the cabinet of Example 13, except that the heat transfer substance 50 is one inch thick Armaflex.

TABLE 43

| 70° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 75 | 0.13 | 25 |
| Back (Length × Height)/144 | 4.25 | 2 | 75 | 0.13 | 21 |
| Side Rt (Depth × Height)/144 | 3.84 | 1 | 43 | 0.27 | 45 |
| Side Lt (Depth × Height)/144 | 4.79 | 2 | 75 | 0.13 | 23 |
| Bottom (Depth × Length)/144 | 4.81 | 2 | 100 | 0.13 | 31 |
| Top (Length × Depth)/144 | 4.00 | 1.5 | 75 | 0.13 | 26 |
| Total Heat Leak Into Cabinet | | | | | 171 |
| ALLOWANCE FOR DOOR (BTU/HR) | | | | | 50 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 289 |
| REFRIGERATOR SIDE | | | | | |
| Front (Door)(Length × Height)/144 | 4.45 | 2 | 32 | 0.13 | 9 |
| Back (Length × Height)/144 | 4.45 | 2 | 32 | 0.13 | 9 |
| Side Rt (Depth × Height)/144 | 3.84 | 1 | 7 | 0.13 | 3 |
| Side Lt (Depth × Height)/144 | 3.84 | 1 | −43 | 0.27 | −45 |
| Bottom (Depth × Length)/144 | 3.50 | 2 | 42 | 0.13 | 10 |
| Top (Length × Depth)/144 | 3.50 | 1.5 | 32 | 0.13 | 10 |
| Total Heat Leak Into Cabinet | | | | | −3 |
| ALLOWANCE FOR DOOR (BTU/HR) | | | | | 25 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 41 |
| CHILLER SIDE | | | | | |
| Front (Door)(Length × Height)/144 | 4.34 | 2 | 25 | 0.13 | 7 |
| Back (Length × Height)/144 | 4.34 | 2 | 25 | 0.13 | 7 |
| Side Rt (Depth × Height)/144 | 5.08 | 2 | 25 | 0.13 | 8 |
| Side Lt (Depth × Height)/144 | 3.84 | 1 | −7 | 0.27 | −7 |
| Bottom (Depth × Length)/144 | 3.75 | 2 | 35 | 0.13 | 9 |
| Top (Length × Depth)/144 | 3.75 | 1.5 | 25 | 0.13 | 8 |
| Total Heat Leak Into Cabinet | | | | | 32 |
| ALLOWANCE FOR DOOR (BTU/HR) | | | | | 20 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 71 |
| TOTAL CABINET LOAD (BTU/HR) | | | | | 400 |

TABLE 44

| 90° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 95 | 0.13 | 31 |
| Back (Length × Height)/144 | 4.25 | 2 | 95 | 0.13 | 26 |
| Side Rt (Depth × Height)/144 | 3.84 | 1 | 43 | 0.27 | 45 |
| Side Lt (Depth × Height)/144 | 4.79 | 2 | 95 | 0.13 | 30 |
| Bottom (Depth × Length)/144 | 4.81 | 2 | 120 | 0.13 | 38 |
| Top (Length × Depth)/144 | 4.00 | 1.5 | 95 | 0.13 | 33 |
| Total Heat Leak Into Cabinet | | | | | 202 |
| ALLOWANCE FOR DOOR (BTU/HR) | | | | | 65 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 335 |
| REFRIGERATOR SIDE | | | | | |
| Front (Door)(Length × Height)/144 | 4.45 | 2 | 52 | 0.13 | 15 |
| Back (Length × Height)/144 | 4.45 | 2 | 52 | 0.13 | 15 |
| Side Rt (Depth × Height)/144 | 3.84 | 1 | 7 | 0.13 | 3 |
| Side Lt (Depth × Height)/144 | 3.84 | 1 | −43 | 0.27 | −45 |
| Bottom (Depth × Length)/144 | 3.50 | 2 | 62 | 0.13 | 14 |
| Top (Length × Depth)/144 | 3.50 | 1.5 | 52 | 0.13 | 16 |
| Total Heat Leak Into Cabinet | | | | | 19 |
| ALLOWANCE FOR DOOR (BTU/HR) | | | | | 35 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 73 |
| CHILLER SIDE | | | | | |
| Front (Door)(Length × Height)/144 | 4.34 | 2 | 45 | 0.13 | 13 |
| Back (Length × Height)/144 | 4.34 | 2 | 45 | 0.13 | 13 |
| Side Rt (Depth × Height)/144 | 5.08 | 2 | 45 | 0.13 | 15 |
| Side Lt (Depth × Height)/144 | 3.84 | 1 | −7 | 0.27 | −7 |
| Bottom (Depth × Length)/144 | 3.75 | 2 | 55 | 0.13 | 13 |
| Top (Length × Depth)/144 | 3.75 | 1.5 | 45 | 0.13 | 15 |
| Total Heat Leak Into Cabinet | | | | | 61 |
| ALLOWANCE FOR DOOR (BTU/HR) | | | | | 30 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 110 |
| TOTAL CABINET LOAD (BTU/HR) | | | | | 518 |

TABLE 45

| 110° F. ambient temperature conditions | | | | |
|---|---|---|---|---|
| MODEL | Length | Depth | Height | Bottom Step |
| Internal | 68" | 20.5 | 26.5 | 4.875" × 8.625" |
| External | 72" | 24" | 30.5 | |

| MODEL (Outside Dimensions) | Sq Ft | Wall Thickness | Delta T | K-Factor | BTU/HR |
|---|---|---|---|---|---|
| FREEZER SIDE | | | | | |
| Front (Door)(Length × Height)/144 | 5.08 | 2 | 115 | 0.13 | 38 |
| Back (Length × Height)/144 | 4.25 | 2 | 115 | 0.13 | 32 |
| Side Rt (Depth × Height)/144 | 3.84 | 1 | 43 | 0.27 | 45 |
| Side Lt (Depth × Height)/144 | 4.79 | 2 | 115 | 0.13 | 36 |
| Bottom (Depth × Length)/144 | 4.81 | 2 | 140 | 0.13 | 44 |
| Top (Length × Depth)/144 | 4.00 | 1.5 | 115 | 0.13 | 40 |
| Total Heat Leak Into Cabinet | | | | | 234 |
| ALLOWANCE FOR DOOR (BTU/HR) | | | | | 75 |
| FAN INPUT (BTU/HR) | | | | | 38 |
| ALLOWANCE FOR HEATERS *(BTU/HR) | | | | | 30 |
| LIGHT INPUT (BTU/HR) | | | | | 0 |
| Total FREEZER Load BTU/HR | | | | | 377 |
| REFRIGERATOR SIDE | | | | | |
| Front (Door)(Length × Height)/144 | 4.45 | 2 | 72 | 0.13 | 21 |
| Back (Length × Height)/144 | 4.45 | 2 | 72 | 0.13 | 21 |
| Side Rt (Depth × Height)/144 | 3.84 | 1 | 7 | 0.13 | 3 |
| Side Lt (Depth × Height)/144 | 3.84 | 1 | −43 | 0.27 | −45 |
| Bottom (Depth × Length)/144 | 3.50 | 2 | 82 | 0.13 | 19 |
| Top (Length × Depth)/144 | 3.50 | 1.5 | 72 | 0.13 | 22 |
| Total Heat Leak Into Cabinet | | | | | 41 |
| ALLOWANCE FOR DOOR (BTU/HR) | | | | | 45 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total REFRIGERATOR Load BTU/HR | | | | | 105 |
| CHILLER SIDE | | | | | |
| Front (Door)(Length × Height)/144 | 4.34 | 2 | 65 | 0.13 | 18 |
| Back (Length × Height)/144 | 4.34 | 2 | 65 | 0.13 | 18 |
| Side Rt (Depth × Height)/144 | 5.08 | 2 | 65 | 0.13 | 21 |
| Side Lt (Depth × Height)/144 | 3.84 | 1 | −7 | 0.27 | −7 |
| Bottom (Depth × Length)/144 | 3.75 | 2 | 75 | 0.13 | 18 |
| Top (Length × Depth)/144 | 3.75 | 1.5 | 65 | 0.13 | 21 |
| Total Heat Leak Into Cabinet | | | | | 90 |
| ALLOWANCE FOR DOOR (BTU/HR) | | | | | 40 |
| FAN INPUT (BTU/HR) | | | | | 19 |
| ALLOWANCE FOR HEATERS *(BTU/HR) | | | | | 0 |
| LIGHT INPUT (BTU/HR) | | | | | 0 |
| Total CHILLER Load BTU/HR | | | | | 149 |
| TOTAL CABINET LOAD (BTU/HR) | | | | | 631 |

The following tables summarize the performance capabilities of the refrigeration systems of the above discussed examples, Examples 1-15. The following tables show the BTU/hour required to maintained specific sections at predetermined temperatures and the total BTU/hour consumed by a cabinet housing such sections. The following tables show this information when the cabinet uses three different thicknesses of heat transfer substance and when the cabinet is positioned in three different ambient temperatures.

TABLE 46

Performance for the freezer/refrigerator combination of Examples 1-3 where the freezer and refrigerator sections each have a single door and are about the same size. The freezer section is maintained between about −5° F. and 5° F. and the refrigerator section is maintained between about 34° F. and 38° F.

| Ambient Temperature | Thickness of Heat Transfer Substance | Freezer Load BTU/Hour | Refrigerator Load BTU/Hour | Total Cabinet Load BTU/Hour |
|---|---|---|---|---|
| 70° F. | ¾ inch | 304 | 36 | 340 |
| 90° F. | ¾ inch | 350 | 77 | 428 |
| 110° F. | ¾ inch | 397 | 118 | 515 |
| 70° F. | ½ inch | 333 | 7 | 340 |
| 90° F. | ½ inch | 380 | 48 | 428 |
| 110° F. | ½ inch | 426 | 88 | 515 |
| 70° F. | 1 inch | 289 | 51 | 340 |
| 90° F. | 1 inch | 335 | 92 | 428 |
| 110° F. | 1 inch | 382 | 133 | 515 |

TABLE 47

Performance for the refrigerator/chiller combination of Examples 4-6 where the refrigerator and chiller sections each have a single door and are about the same size. The refrigerator section is maintained between about 34° F. and 38° F. and the chiller section is maintained at about 45° F.

| Ambient Temperature | Thickness of Heat Transfer Substance | Refrigerator Load BTU/Hour | Chiller Load BTU/Hour | Total Cabinet Load BTU/Hour |
|---|---|---|---|---|
| 70° F. | ¾ inch | 110 | 71 | 181 |
| 90° F. | ¾ inch | 231 | 116 | 347 |
| 110° F. | ¾ inch | 278 | 157 | 435 |
| 70° F. | ½ inch | 115 | 66 | 181 |
| 90° F. | ½ inch | 236 | 112 | 347 |
| 110° F. | ½ inch | 282 | 155 | 438 |
| 70° F. | 1 inch | 108 | 73 | 181 |
| 90° F. | 1 inch | 229 | 119 | 347 |
| 110° F. | 1 inch | 275 | 160 | 435 |

TABLE 48

Performance for the refrigerator/chiller combination of Examples 7-9 where refrigerator and chiller sections each have a single door and are about the same size. The refrigerator section is maintained between about 34° F. and 38° F. and the chiller section is maintained at about 65° F.

| Ambient Temperature | Thickness of Heat Transfer Substance | Refrigerator Load BTU/Hour | Chiller Load BTU/Hour | Total Cabinet Load BTU/Hour |
|---|---|---|---|---|
| 70° F. | ¾ inch | 138 | 2 | 140 |
| 90° F. | ¾ inch | 180 | 38 | 217 |
| 110° F. | ¾ inch | 221 | 74 | 295 |
| 70° F. | ½ inch | 157 | −17 | 140 |
| 90° F. | ½ inch | 198 | 19 | 217 |
| 110° F. | ½ inch | 240 | 55 | 295 |
| 70° F. | 1 inch | 129 | 11 | 140 |
| 90° F. | 1 inch | 170 | 47 | 217 |
| 110° F. | 1 inch | 212 | 83 | 295 |

TABLE 49

Performance for the freezer/refrigerator combination of Examples 10-12 where the freezer section has one door and the refrigerator section has two doors and is about twice the size of the freezer section. The freezer section is maintained between about −5° F. and 5° F. and the refrigerator section is maintained between about 34° F. and 38° F.

| Ambient Temperature | Thickness of Heat Transfer Substance | Freezer Load BTU/Hour | Refrigerator Load BTU/Hour | Total Cabinet Load BTU/Hour |
|---|---|---|---|---|
| 70° F. | ¾ inch | 304 | 106 | 410 |
| 90° F. | ¾ inch | 350 | 184 | 534 |
| 110° F. | ¾ inch | 397 | 261 | 658 |
| 70° F. | ½ inch | 333 | 77 | 410 |
| 90° F. | ½ inch | 380 | 154 | 534 |
| 110° F. | ½ inch | 426 | 231 | 658 |
| 70° F. | 1 inch | 289 | 121 | 410 |
| 90° F. | 1 inch | 335 | 199 | 534 |
| 110° F. | 1 inch | 382 | 276 | 658 |

TABLE 50

Performance for the freezer/refrigerator/chiller combination of Examples 13-15. The freezer, refrigerator, and chiller sections each have a single door and are about the same size. The freezer section is maintained between about −5° F. and 5° F., the refrigerator section is maintained between about 34° F. and 38° F., and the chiller section is maintained at about 45° F.

| Ambient Temperature | Thickness of Heat Transfer Substance | Freezer Load BTU/Hour | Refrigerator Load BTU/Hour | Chiller Load BTU/Hour | Total Cabinet Load BTU/Hour |
|---|---|---|---|---|---|
| 70° F. | ¾ inch | 304 | 27 | 68 | 399 |
| 90° F. | ¾ inch | 350 | 59 | 108 | 517 |
| 110° F. | ¾ inch | 392 | 91 | 147 | 630 |
| 70° F. | ½ inch | 333 | 0 | 63 | 396 |
| 90° F. | ½ inch | 380 | 32 | 103 | 514 |
| 110° F. | ½ inch | 421 | 64 | 142 | 627 |
| 70° F. | 1 inch | 289 | 41 | 71 | 400 |
| 90° F. | 1 inch | 335 | 73 | 110 | 518 |
| 110° F. | 1 inch | 377 | 105 | 149 | 631 |

The refrigeration system of the present invention may have other applications aside from use in connection with food and beverage articles and the invention may be implemented in a variety of configurations, using certain features or aspects of the several embodiments described herein and others known in the art. Thus, although the invention has been herein shown and described in what is perceived to be the most practical and preferred embodiments, it is to be understood that the invention is not intended to be limited to the specific features and embodiments set forth above. Rather, it is recognized that modifications may be made by one of skill in the art of the invention without departing from the spirit or intent of the invention and, therefore, the invention is to be taken as including all reasonable equivalents to the subject matter of the claims.

We claim:

1. A multi temperature zone refrigeration system comprising:

a container with at least two different temperature cooling zones;

a divider separating the at least two cooling zones, where the divider has a wall and a partition spaced therefrom to define a heat exchange chamber, the partition being formed of a heat transfer plate having a sheet and a heat transfer substance attached to the sheet;

a compressor system having refrigeration and hot-gas defrost modes, where the compressor system is in communication with at least one of the cooling zones; and a controller functionally connected to the compressor system for selectably operating the compressor system.

2. The refrigeration system of claim 1 where the compressor system has a variable capacity compressor.

3. The refrigeration system of claim 1, where the compressor system comprises:

a variable capacity compressor;

a condenser;

a heat exchanger; and, an evaporator, where the variable capacity compressor is connected to the condenser, the condenser is connected to the heat exchanger, the heat exchanger is connected to the evaporator, and the evaporator is connected to the variable capacity compressor thereby forming a closed system in which refrigerant travels.

4. The refrigeration system of claim 3, where the compressor system further comprises:

a drier positioned between the condenser and the evaporator and connected to the condenser and evaporator; and, a hot-gas bypass valve connected to the drier and the evaporator, where the hot-gas bypass valve and heat exchanger are connected in parallel to the drier and evaporator.

5. The refrigeration system of claim 1 where the heat transfer substance is insulation.

6. The refrigeration system of claim 5 where the insulation is closed cell urethane.

7. The refrigeration system of claim 6 where the closed cell urethane is Armaflex.

8. The refrigeration system of claim 7 where about ½ inch to 1 inch of Armaflex is engaged to the metal sheet of the heat transfer substance.

9. A compressor system including:

a variable capacity compressor;

a condenser connected to the variable capacity compressor;

a drier connected to the condenser;

a hot-gas bypass valve;

a heat exchanger, the hot gas bypass valve and the heat exchanger connected to the drier in parallel; and, an evaporator connected to the hot gas bypass valve and to the heat exchanger, where the evaporator is connected to the variable capacity compressor thereby forming a closed system in which refrigerant travels, where the compressor system selectably operates in at least a refrigeration mode and a hot-gas defrost mode, and the evaporator is defrosted by circulation of gas therethrough.

10. The compressor system of claim 9 further comprising a controller functionally engaged to the hot-gas bypass valve where the controller selectably opens and closes the hot-gas bypass valve.

11. A temperature divider comprising:

a wall;

a partition spaced a distance from the wall, the partition having at least one metal sheet with a heat transfer substance attached thereto;

a damper positioned in the partition; and, a heat exchange chamber defined by the wall and partition.

12. The temperature divider of claim 11 further comprising a vent positioned in the wall.

13. The temperature divider of claim 11 where the heat transfer substance is insulation.

14. The temperature divider of claim 11 where the insulation is closed cell urethane.

15. The temperature divider of claim 11 where the closed cell urethane is Armaflex.

16. The temperature divider of claim 11 further comprising a fan positioned in the wall.

17. A multi temperature zone refrigeration system comprising:

a cabinet with at least two different temperature cooling zones;

a single compressor system engaged to the cabinet for cooling the at least two temperature cooling zones; and, a temperature divider positioned between and separating the at least two different temperature cooling zones, the temperature divider having a wall, a partition spaced a distance from the wall, the partition having at least one metal sheet with a heat transfer substance attached thereto, and a heat exchange chamber defined by the wall and partition.

18. The multi temperature zone refrigeration system of claim 17 where the heat transfer substance is closed cell urethane.

19. The multi temperature zone refrigeration system of claim 17 further comprising a fan positioned in the wall.

20. The multi temperature zone refrigeration system of claim 17 further comprising a damper positioned in the partition and a vent positioned in the wall to allow air to circulate there through.

21. The multi temperature zone refrigeration system of claim 17 where the compressor system comprises:

a variable capacity compressor;

a condenser;

a drier;

a hot-gas bypass valve;

a heat exchanger; and, an evaporator, where the variable capacity compressor is connected to the condenser, the condenser is connected to the drier, the drier is connected to the hot-gas bypass valve and the heat exchanger in parallel, the hot-gas bypass valve and heat exchanger are connected to the evaporator, and the evaporator is connected to the variable capacity compressor thereby forming a closed system in which refrigerant travels.

22. The multi temperature zone refrigeration system of claim 21 where the compressor system further comprises a controller functionally engaged to the hot-gas bypass valve where the controller selectably opens and closes the hot-gas bypass valve.

23. The multi temperature zone refrigeration system of claim 17 where the cabinet has three different temperature cooling zones and one temperature zone is a freezer maintained between about −5° F. and 5° F., one temperature zone is a refrigerator maintained between about 34° F. and 38° F., and one temperature zone is a chiller maintained between about 45° F. and 65° F.

24. The multi temperature zone refrigeration system of claim 17 where the heat transfer substance is between about ½ inch and 1 inch thick.

25. A multi temperature zone refrigeration system comprising:

a cabinet with at least two different temperature cooling zones;

a cooling system engaged to the cabinet; and, a temperature divider positioned between and separating the at least two different temperature cooling zones, the temperature divider having a wall, a partition spaced a distance from the wall, the partition having at least one metal sheet with a heat transfer substance of closed cell urethane attached thereto, and a heat exchange chamber defined by the wall and partition.

26. The multi temperature zone refrigeration system of claim 25 where the cooling system is a compressor system comprising a closed system having an evaporator functionally engages to a variable capacity compressor, where compressor system selectably operates in at least a refrigeration mode and a hot-gas defrost mode an the evaporator is defrosted by circulated gas there through.

27. The multi temperature zone refrigeration system of claim 25 where the compressor system comprises:

a variable capacity compressor;

a condenser;

a drier;

a hot-gas bypass valve;

a heat exchanger;

an evaporator;

where the variable capacity compressor is connected to the condenser, the condenser is connected to the drier, the drier is connected to the hot-gas bypass valve and the heat exchanger in parallel, the hot-gas by-pass valve and heat exchanger are connected to the evaporator, and the evaporator is connected to the variable capacity compressor thereby forming a closed system in which refrigerant travels; and, a controller functionally engaged to the hot-gas by-pass valve where the controller selectably opens and closes the hot-gas bypass valve.

28. A method of defrosting a variable capacity compressor cooling system with gas comprising the steps of:

having a controller signal a hot-gas bypass valve to selectably open;

having a variable capacity compressor compress relatively low pressure gas into a relatively high pressure gas;

circulating the high pressure gas from the variable capacity compressor into a condenser, then into a drier, through the open hot-gas bypass valve, and into an evaporator;

melting accumulated frost on the evaporator and thereby reducing the pressure of the gas; and, returning the relatively low pressure gas to the variable capacity compressor.

* * * * *